US006849312B1

(12) United States Patent
Williams

(10) Patent No.: US 6,849,312 B1
(45) Date of Patent: Feb. 1, 2005

(54) IMAGE TRANSFER SHEET WITH TRANSFER BLOCKING OVERCOAT AND HEAT TRANSFER PROCESS USING THE SAME

(75) Inventor: Scott A. Williams, Rapid City, SD (US)

(73) Assignee: Foto-Wear, Inc., Milford, PA (US)

( * ) Notice: Subject to any disclaimer, the term of this patent is extended or adjusted under 35 U.S.C. 154(b) by 0 days.

(21) Appl. No.: 09/980,589

(22) PCT Filed: May 19, 2000

(86) PCT No.: PCT/US00/13746

§ 371 (c)(1),
(2), (4) Date: Aug. 6, 2002

(87) PCT Pub. No.: WO00/69658

PCT Pub. Date: Nov. 23, 2000

Related U.S. Application Data

(60) Provisional application No. 60/134,849, filed on May 19, 1999.

(51) Int. Cl.[7] ..... B41M 5/40

(52) U.S. Cl. ..... 428/32.81; 428/423.1; 428/480; 428/500; 156/230

(58) Field of Search ..... 428/32.81, 423.1, 428/480, 500, 32.6; 156/230

(56) References Cited

U.S. PATENT DOCUMENTS 4,517,044 A 5/1985 Arnold ..... 156/277
4,567,114 A * 1/1986 Oshima et al. ..... 428/430
4,726,979 A 2/1988 Chapman ..... 428/200
5,766,731 A * 6/1998 Stein et al. ..... 428/195.1
2003/0008116 A1 * 1/2003 Williams et al. ..... 428/195

FOREIGN PATENT DOCUMENTS

EP 0 950 509 A 10/1999
FR 2 442 721 A 6/1980

OTHER PUBLICATIONS

Patent Abstract of Japan, vol. 014, No. 291 (M–0989), Jun. 22, 1990.

* cited by examiner

*Primary Examiner*—B. Shewareged
(74) *Attorney, Agent, or Firm*—Birch, Stewart, Kolasch & Birch, LLP

(57) ABSTRACT

An image transfer sheet, having a support sheet, an optional barrier layer on the support sheet, a heat release layer on the optional barrier layer or on the support sheet, an optional image-receiving layer on the heat release layer, a design layer having image and non-image areas on the optional image-receiving layer on the heat release layer, an optional non-water-dispersible polymer layer on the design layer, and a transfer blocking overcoat layer on the optional polymer layer or the design layer, is used in a dry heat transfer process to transfer an image area to a receptor.

44 Claims, 3 Drawing Sheets

IMAGE TRANSFER SHEET WITH TRANSFER BLOCKING OVERCOAT AND HEAT TRANSFER PROCESS USING THE SAME

This application is the national phase under 35 U.S.C. § 371 of PCT International Application No. PCT/US00/13746 which has an International filing date of May 19, 2000, which designated the United States of America and was published in English which claimed benefit of Provisional Application No. 60/134,849 filed May 19, 1999.

BACKGROUND OF THE INVENTION

1. Field of the Invention

The present invention relates to a transfer material and process for offset printing of a heat transferable material having a transfer blocking overcoat.

2. Description of the Prior Art

Textiles such as shirts (e.g., tee shirts) having a variety of designs thereon have become very popular in recent years. Many shirts are sold with pre-printed designs to suit the tastes of consumers. In addition, many customized tee shirt stores are now in the business of permitting customers to select designs or decals of their choice. Processes have also been proposed which permit customers to create their own designs on transfer sheets for application to tee shirts by use of a conventional hand iron, such as described in U.S. Pat. No. 4,244,358 issued Sep. 23, 1980. Furthermore, U.S. Pat. No. 4,773,953 issued Sep. 27, 1988, is directed to a method for utilizing a personal computer, a video camera or the like to create graphics, images, or creative designs on a fabric.

U.S. Pat. No. 5,620,548 is directed to a silver halide photographic transfer element and to a method for transferring an image from the transfer element to a receptor surface. Provisional application 60/029,917 discloses that the silver halide light sensitive grains be dispersed within a carrier that functions as a transfer layer, and does not have a separate transfer layer. Provisional application 60/056,446 discloses that the silver halide transfer element has a separate transfer layer. Provisional Application 60/065,806 relates to a transfer element using CYCOLOR technology, and has a separate transfer layer. Provisional Application 60/065,804 relates to a transfer element using thermo-autochrome technology, and has a separate transfer layer. Provisional application 60/030,933 relates to a transfer element using CYCOLOR and thermo-autochrome technology, but having no separate transfer layer.

U.S. Pat. No. 5,798,179 is directed to a printable heat transfer material using a thermoplastic polymer such as a hard acrylic polymer or polylvinyl acetate) as a barrier layer, and has a separate film-forming binder layer.

U.S. Pat. No. 5,271,990 relates to an image-receptive heat transfer paper which includes an image-receptive melt-transfer film layer comprising a thermoplastic polymer overlaying the top surface of a base sheet.

U.S. Pat. No. 5,502,902 relates to a printable material comprising a thermoplastic polymer and a film-forming binder.

U.S. Pat. No. 5,614,345 relates to a paper for thermal image transfer to flat porous surfaces, which contains an ethylene copolymer or a ethylene copolymer mixture and a dye-receiving layer.

Provisional application 60/127,625, filed Apr. 1, 1999 relates to relates to a polymeric composition comprising an acrylic dispersion, an elastomeric emulsion, a plasticizer, and a water repellant.

One problem with many known transfer sheets is the loss of "hand" or the formation of hard or brittle images on the substrate. Over time, these image layers crack, chip and peel from the substrate resulting in a reduction in the esthetic appeal of the transfer image. For example, images prepared by conventional screen printing followed by dry heat transfer to a cloth substrate frequently crack and peel from the substrate with repeated laundering.

Additionally, polymer layers used to prepare laminate transfer sheets are frequently transferred to the substrate itself during dry heat transfer. The transferred polymeric materials also reduce the "hand" of the image printed substrate and often produce a halo of clear polymer around the transferred image. The transferred polymer halo detracts from the imaged substrate by reducing the sharpness and clarity of the transferred image.

The prior art has attempted to solve the polymer halo problem by applying an adhesive polymer or adhesive varnish over an image and in close register to the image. During heat transfer, the polymer or adhesive varnish covering the image bonds the image to the substrate only within the outline of the image thereby substantially eliminating the polymer halo. U.S. Pat. Nos. 3,959,555, 4,308,310 and 4,517,044 described different ways to achieve this result. Although these processes minimize the polymer halo, the transferred image remains susceptible to cracking and peeling. U.S. Pat. No. 4,786,349 describes a heat transfer process in which an absorbing sheet is used between a heated platen and a thermoplastic layer having characters printed thereon. The absorbing sheet has a greater affinity for softened or molten thermoplastic adhesive of the thermoplastic sheet and absorbs the heated adhesive, thereby minimizing the polymer halo transferred to the substrate. This method also, however, does not prevent the transferred image from cracking and peeling.

In an attempt to solve the halo problem, U.S. Pat. No. 5,741,387 provided for a laminated image transfer sheet having a support sheet, a heat release layer on the support sheet, an ink design layer on the heat release layer, a polymer containing a water-dispersible polymer on the ink design layer and a lacquer mask layer on the water-dispersible polymer layer. In particular, the mask layer was deposited on the water-dispersible polymer layer such that the mask layer outlined the ink design in the ink design layer, but did not cover the ink design itself. This allowed for transfer of only the heat release layer, the ink design and the water-dispersible polymer layer within the outlined ink design. However, there were several drawbacks to the process of U.S. Pat. No. 5,741,387. First, the problem of cracking, chipping and peeling of the image layers over time still existed. Second, the application of the image layer to the substrate required a considerable amount of pressure. Specifically, a pneumatic heat transfer press which exerts from 30 to 120 pounds per square inch (psi) was required. Thus, a conventional iron was rot sufficient for achieving the pressure necessary to transfer the image from the transfer sheet of U.S. Pat. No. 5,741,387 to a substrate, such as a tee shirt.

Accordingly, there continue to exist problems associated with clearly transferring an image to a substrate and providing for the "hand" or feel of the substrate after the image has been transferred. This need is also combined with the requirement that the transfer can be effected with the use of a conventional hand-iron.

SUMMARY OF THE INVENTION

In order to attract the interest of consumer groups that are already captivated by the tee shirt rage described above, the present invention provides, in one embodiment, an improved transfer sheet. In another embodiment, the present invention provides for a process of dry heat transfer of images to receptors. A unique advantage of the present invention is that it allows for the reduction of the polymer halo around the transferred image. The present invention also provides for the "hand" or feel of the substrate after transferring. Furthermore, the transfer process of the present invention can be effected by the use of a conventional hand iron. Thus, the present invention enables all consumers to wear and display apparel carrying designs that were formed on the transfer material and by the process of the present invention in a timely and cost efficient means.

Accordingly, the present invention relates to a transfer transferable material and a process for offset printing of a heat transferable material having a transfer blocking overcoat.

In one embodiment, the present invention provides for a transfer sheet comprising a support, a heat release polymer layer, a design layer containing image and non-image areas, and a transfer blocking overcoat layer, wherein the transfer blocking overcoat layer is applied on top of non-image areas only.

In another embodiment, the present invention provides for a transfer sheet comprising a support, a heat release polymer layer on one side of the support, a design layer containing image and non-image areas on top of the heat release polymer layer, a polymer layer containing a clear or colored non-water dispersible polymer on top of the design layer, and a transfer blocking overcoat layer, wherein the transfer blocking overcoat layer is applied on top of non-image areas only.

In another embodiment, the present invention provides for a transfer sheet comprising a support, a heat release polymer layer on one side of the support, an layer containing image and non-image areas on top of the heat release polymer layer, a polymer layer containing a clear or colored non-water dispersible polymer, and a transfer blocking overcoat layer, wherein the polymer layer containing a clear or colored non-water dispersible polymer is applied on top of the image areas only, and the transfer blocking overcoat layer is applied on top of the non-image areas only.

The present invention also provides for an optional to barrier layer to be coated between the support and the heat release layer. Additionally, the present invention provides for an optional image-receiving layer to be coated between the transfer layer and the design layer. Furthermore, in another embodiment of the present invention, the components of the design layer and the components of the heat release layer may be combined in the same layer.

The present invention further provides for a method of heat transferring each of the above image areas from the transfer sheet to a receptor. In the process for transferring the image areas from the transfer sheet to a receptor, the receptor is placed in contact with the transfer blocking overcoat layer and heat is applied through the support layer. Upon heating, the optional non-water dispersible layer, the image areas, and the heat release layer, within the outline formed by the transfer blocking overcoat layer, are thermally transferred through the transfer blocking overcoat onto and/or into the receptor. The support is then allowed to optionally cool before removing from the receptor. When the support is not allowed to cool prior to removing the support, this is known as "hot-peel."

BRIEF DESCRIPTION OF THE DRAWINGS

The present invention will become more fully understood from the detailed description given hereinbelow, and the accompanying drawings that are given by way of illustration only and thus are not limitive of the present invention, and wherein:

FIG. 3 illustrates the step of ironing the transfer element of the present invention onto a tee shirt or the like.

DETAILED DESCRIPTION OF THE INVENTION

Figure 1:
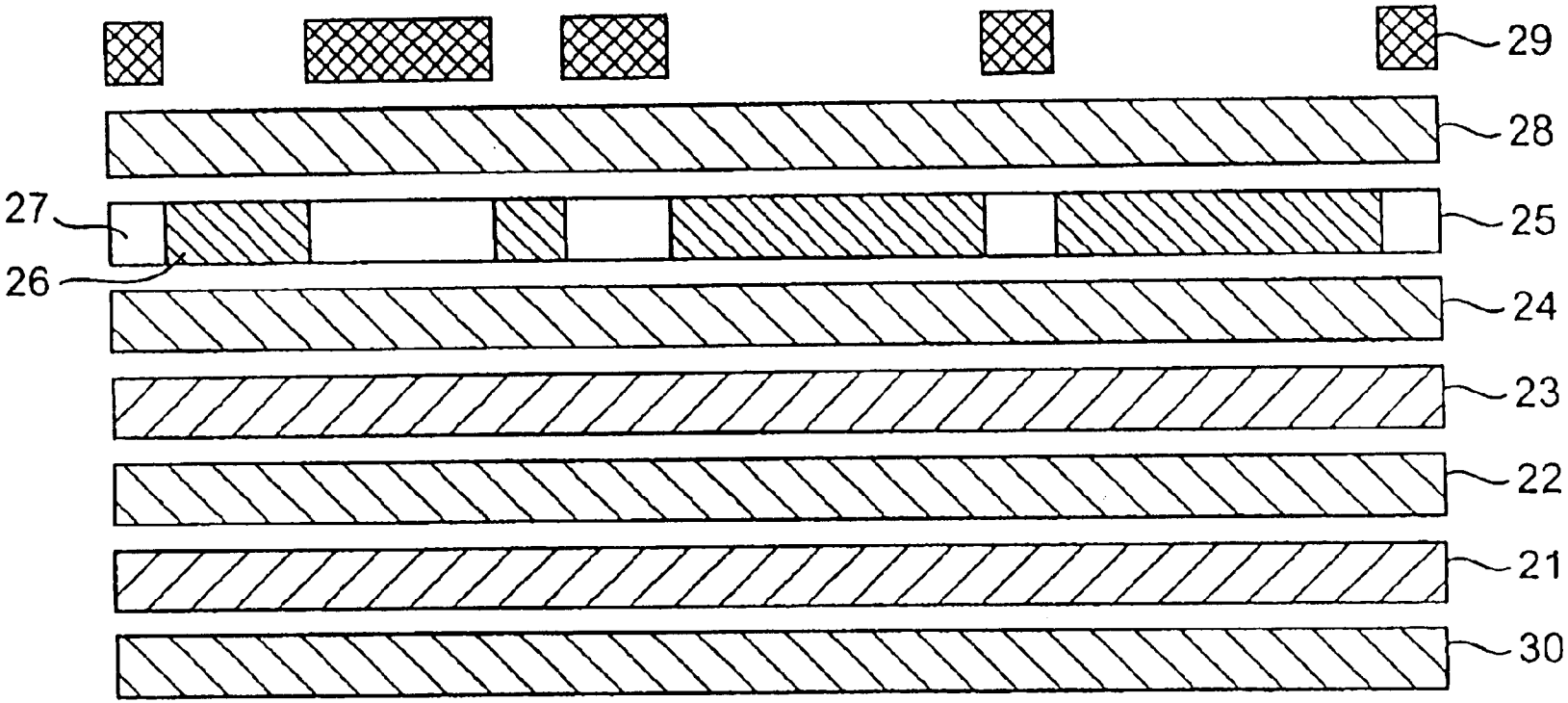
FIG. 1 is a cross-sectional view of one embodiment of the transfer element of the present invention.

The present invention includes a thermal transfer sheet and a transfer method for transferring the image area from said thermal transfer sheet to a receptor element.

In one embodiment, the present invention provides for a transfer sheet comprising a support, a heat release polymer layer, a design layer containing image and non-image areas, and a transfer blocking overcoat layer, wherein the transfer blocking overcoat layer is applied on top of non-image areas only. In another embodiment, the present invention provides for a clear or colored polymer layer comprising a non-water-dispersible polymer, hereinafter referred to as the "polymer layer" or the "non-water-dispersible polymer layer", wherein said polymer layer is placed between the design layer and the transfer blocking overcoat layer. In another embodiment of the present invention, the polymer layer is applied on top of the image areas of the design layer only, and the transfer blocking overcoat layer is applied on top of the non-image areas of the design layer only.

It is to be noted that the present invention does not utilize a polymer layer containing a water-soluble or water-dispersible polymer. In particular, the present invention does not utilize a water-dispersible polymer layer at any point between the design layer and the transfer blocking overcoat layer.

The present invention further provides for a method of heat transferring each of the above image areas from the transfer sheet to a receptor. In this process, the receptor is placed in contact with the transfer blocking overcoat layer and heat is applied through the support, whereupon the optional polymer layer, image area, and heat release layer, within the outline formed by the transfer blocking overcoat layer, are thermally transferred onto and/or into the substrate. During the transfer process, the transfer blocking overcoat prevents transfer of the optional polymer layer, the non-image areas of the design layer, and the heat release layer underlying the transfer blocking overcoat. This transfer process results in the transfer of the image areas having a clear outline which is coincident with the outline of the heat transferred optional polymer layer and the heat release layer. Since heat transfer occurs through the transfer blocking overcoat only, no polymer halo is formed on the receptor.

A. The Transfer Material

1. Support

The support is a thin flexible, but non-elastic carrier sheet upon which the release layer can be formed and serves as a support for the production of an image on the transfer material and from which the image can be released. The support is not particularly limited and may be any conventional support sheet which is suitably flexible and upon which the heat release layer, ink design layer, polymer layer and mask layer can be formed. Typically, the support sheet is a paper web, plastic film, metal foil, wood pulp fiber paper, vegetable parchment paper, lithographic printing paper or similar material.

In one embodiment of the present invention the support provides a surface that will promote or at least not adversely affect image adhesion and image release to the receptor. An appropriate support material may include but is not limited to a cellulosic nonwoven web or film, such as a smooth surface, heavyweight (approximately 24 lb.) laser printer or color copier paper stock or laser printer transparency (polyester) film. Additionally, the support of the present invention may be a sheet of laser copier/printer paper or a polyester film base. However, highly porous supports are less preferred because they tend to absorb large amounts of the toner in copiers without providing as much release. The particular support used is not known to be critical, so long as the substrate has sufficient strength for handling, copying, coating, heat transfer, and other operations associated with the present invention. Accordingly, in accordance with some embodiments of the present invention, the support may be the base material for any printable material, such as described in U.S. Pat. No. 5,271,990 to Kronzer.

The support may be impregnated with a reactive non-staining non-thermosetting polymer as a binder to provide improved tensile strength to the support sheet. Suitable polymers include acrylic polymers which are contained in the product designated HYCAR sold by BF Goodrich Chemical Company of Cleveland, Ohio. The support before impregnation may have a weight of about 12–16 lbs per 1,300 $ft^2$; the impregnated paper may have a weight of about 16–20 lbs per 1,300 $ft^2$ and a thickness of 3–5 mils±0.5 mil.

2. The Optional Barrier Layer

The barrier layer is an optional first coating on the support. The barrier layer also assists in releasing the image layer and the release layer(s). The barrier layer comprises a polymer that helps to prevent both the release layer and the toner from adhering to the support. When the support performs the same function as the barrier layer, the barrier layer is not required. For example, when the support is a polyester film base, such as polyacetate, there will be minimal adherence to the support by the heat release layer. Accordingly, a barrier layer will not be required.

Thus, the barrier layer is a coating that separates the release layer from the support (i.e., paper). The barrier layer, when necessary, is between the support and the release layer. Furthermore, in a preferred embodiment of the invention, the barrier layer is present as both a cold and hot peelable coating, and in either case remains with the support after transfer.

Preferably, the barrier layer is any vinyl acetate with a Tg in the range of from −10° C. to 100° C. Alternatively, the Tg may be in the range of from 0° C. to 100° C. EVERFLEX G, with a Tg of about −7°, may also be used.

The barrier layer according to the present invention may have a solution viscosity of from 5 to 50 cP, preferably 10–35 cP, most preferably about 25 cP, as measured on a Brookfield DV-I+ viscometer, LV1 spindle at 60 rpm at a temperature of 28° C. Additionally, the barrier layer may be wet coated in an amount of from 1 $g/m^2$ to 70 $g/m^2$, preferably from 10–45 $g/m^2$, most preferably about 30 $g/m^2$. The surface tension of the barrier layer may be from 10–70 dynes/cm, preferably from 25–60 dynes/cm, most preferably about 45 dynes/cm as measured at room temperature. A suitable barrier layer may be the release layer of U.S. Pat. No. 5,798,179 to Kronzer. The barrier layer may be composed of a thermoplastic polymer having essentially no tack at transfer temperatures (e.g., 177° C.), a solubility parameter of at least about 19 $(Mpa)^{1/2}$, and a glass transition temperature of at least about 0° C. As used herein, the phrase "having essentially no tack at transfer temperatures" means that the barrier layer does not stick to the release layer to an extent sufficient to adversely affect the quality of the transferred image. By way of illustration, the thermoplastic polymer may be a hard acrylic polymer or poly(vinyl acetate). For example, the thermoplastic polymer may have a glass transition temperature ($T_g$) of at least about 25° C. As another example, the $T_g$ may be in a range of from about 25° C. to about 100° C. The barrier layer also may include an effective amount of a release-enhancing additive, such as a divalent metal ion salt of a fatty acid, a polyethylene glycol, or a mixture thereof. For example, the release-enhancing additive may be calcium stearate, a polyethylene glycol having a molecular weight of from about 2,000 to about 100,000, or a mixture thereof.

When EVERFLEX G, described above, is used as part of the barrier layer, the barrier layer possesses both hot and cold peel properties. That is, after heat is applied to the coated transfer sheet and the image is transferred to the receptor, the transfer sheet may be peeled away from the receptor before it is allowed to cool (i.e., "hot peel"). Alternatively, the transfer sheet is allowed to cool before it is peeled away from the receptor (i.e., "cold peel").

In one embodiment of the present invention, the barrier layer is a vinyl acetate polymer. In another embodiment of the present invention, the barrier layer contains a polyester resin such as polymethyl methacrylate (PMMA) in a molecular weight range of from 15,000 to 120,000 Daltons.

By way of example, the barrier layer may comprise the following polymers which have suitable glass transition temperatures as disclosed in U.S. Pat. No. 5,798,179 to Kronzer:

| Polymer Type | Product Identification |
|---|---|
| Polyacrylates | Hycar ® 26083, 26084, 26120, 26104, 26106, 26322, B. F. Goodrich Company, Cleveland, Ohio<br>Rhoplex ® HA-8, HA-12, NW-1715, Rohm and Haas Company, Philadelphia, Pennsylvania<br>Carboset ® XL-52. B. F. Goodrich Company, Cleveland, Ohio |
| Styrene-butadiene copolymers | Butofan ® 4264, BASF Corporation, Sarnia, Ontario, Canada<br>DL-219, DL-283, Dow Chemical Company, Midland, Michigan |
| Ethylene-vinyl acetate copolymers | Dur-O-Set ® E-666, E-646, E-669, National Starch & Chemical Co., Bridgewater, New Jersey |
| Nitrile rubbers | Hycar ® 1572, 1577, 1570 × 55, B. F. Goodrich Company, Cleveland, Ohio |
| Poly(vinyl chloride) | Vycar ® 352, B. F. Goodrich Company, Cleveland, Ohio |
| Poly (vinyl acetate) | Vinac XX-210, Air Products and Chemicals, Inc., Napierville, Illinois |
| Ethylene-acrylate copolymers | Michem ® Prime, 4990, Michelman, Inc., Cincinnati, Ohio<br>Adcote 56220, Morton Thiokol, Inc., Chicago, Illinois |

Additionally, the barrier layer of the present invention may also comprise the barrier layer disclosed in U.S. Provisional Application No. 60/130,500 filed on Apr. 23, 1999.

3. Optional Antistatic Layer

In accordance with one embodiment of the invention, the support must be usable in a laser copier or laser printer. A preferred support for this embodiment is equal to or less than approximately 4.0 mils thick. The antistatic layer according to the present invention may have a solution viscosity of from 0.1 to 20 cP, preferably 1–5 cP, most preferably about 2 cP, as measured on a Brookfield DV-I+ viscometer, LV1 spindle at 60 rpm at a temperature of 25° C. Additionally, the antistatic layer may be wet coated in an amount of from 1 $g/m^2$ to 50 $g/m^2$, preferably from 10–30 $g/m^2$, most preferably about 18 $g/m^2$. The surface tension of the antistatic layer may be from 30–110 dynes/cm, preferably from 50–90 dynes/cm, most preferably about 70 dynes/cm as measured at room temperature.

Since this particular support is useable in a laser copier or laser printer, antistatic agents may be present. The antistatic agents may be present in the form of a coating on the back surface of the support as an additional layer. The back surface of the support is the surface that is not previously coated with the release layer, optional barrier layer, etc.

When the antistatic agent is applied as a coating onto the back surface of the support, the coating will help eliminate copier or printer jamming by preventing the electrostatic adhesion of the paper base to the copier drum of laser and electrostatic copiers and printers. Antistatic agents, or "antistats" are generally, but not necessarily, conductive polymers that promote the flow of charge away from the paper. Antistats can also be "humectants" that modulate the level of moisture in a paper coating that affects the build up of charge. Antistats are commonly charged tallow ammonium compounds and complexes, but also can be complexed organometallics. Antistats may also be charged polymers that have a similar charge polarity as the copier/printer drum; whereby the like charge repulsion helps prevent jamming.

Antistatic agents include, by way of illustration, derivatives of propylene glycol, ethylene oxide-propylene oxide block copolymers, organometallic complexes such as titanium dimethylacrylate oxyacetate, polyoxyethylene oxide-polyoxyproylene oxide copolymers and derivatives of cholic acid.

More specifically, commonly used antistats include those listed in the *Handbook of Paint and Coating Raw Materials*, such as t-Butylaminoethyl methacrylate; Capryl hydroxyethyl imidazoline; Cetethyl morpholinium ethosulfate; Cocoyl hydroxyethyl imidazoline Di(butyl, methylpyrophosphato) ethylenetitanate di(dioctyl, hydrogen phosphite); Dicyclo (dioctyl)pyrophosphato; titanate; Di (dioctylphosphato) ethylene titanate; Dimethyl diallyl ammonium chloride; Distearyldimonium chloride; N,N'-Ethylene bis-ricinoleamide; Glyceryl mono/dioleate; Glyceryl oleate; Glyceryl stearate; Heptadecenyl hydroxyethyl imidazoline; Hexyl phosphate; N(β-Hydroxyethyl) ricinoleamide; N-(2-Hydroxypropyl) benzenesulfonamide; Isopropyl4-aminobenzenesulfonyl di(dodecylbenzenesulfonyl)titanate; Isopropyl dimethacryl isostearoyl titanate; isopropyltri(dioctylphosphato) titanate; Isopropyl tri(dioctylpyrophosphato)titanate; Isopropyl tri(N ethylaminoethylamino) titanate; (3-Lauramidopropyl) trimethyl ammonium methyl sulfate; Nonyl nonoxynol-15; Oleyl hydroxyethylimidazoline; Palmitic/stearic acid mono/diglycerides; PCA; PEG-36 castor oil, PEG-10 cocamine; PEG-2 laurate; PEG-2; tallowamine; PEG-5 tallowamine; PEG-15 tallowamine; PEG-20 tallowamine; Poloxamer 101; Poloxamer 108; Poloxamer 123; Poloxamer 124; Poloxamer 181; Poloxamer 182; Polaxamer 184; Poloxamer 185; Poloxamer 188; Poloxamer 217; Poloxamer 231; Poloxamer 234; Poloxamer 235; Poloxamer 237; Poloxamer 282; Poloxamer 288; Poloxamer 331; Polaxamer 333; Poloxamer 334; Poloxamer 333; Poloxamer 338; Poloxamer 401; Poloxamer 402; Poloxamer 403; Poloxamer 407; Poloxamine 304; Poloxamine 701; Poloxamine 704; Polaxamine 901; Poloxamine 904; Poloxamine 908; Poloxamine 1107; Poloxamine 1307; Polyamide/epichlorohydrin polymer; Polyglyceryl-10 tetraoleate; Propylene glycol laurate; Propylene glycol myristate; PVM/MA copolymer; polyether; Quaternium-18; Slearamidopropyl dimethyl-β-hydroxyethyl ammonium dihydrogen phosphate; Stearamidopropyl dimethyl-2-hydroxyethyl ammonium nitrate; Sulfated peanut oil; Tetra (2, diallyoxymethyl-1 butoxy titanium di (di-tridecyl) phosphite; Tetrahydroxypropyl ethylenediamine; Tetraisopropyl di (dioctylphosphito) titanate; Tetraoctyloxytitanium di (ditridecylphosphite); Titanium di (butyl, octyl pyrophosphate) di (dioctyl, hydrogen phosphite) oxyacetate; Titanium di (cumylphenylate) oxyacetate; Titanium di (dioctylpyrophosphate) oxyacetate; Titanium dimethacrylate oxyacetate.

Preferably, Marklear AFL-23 or Markstat AL-14, polyethers available from Whitco Industries, are used as an antistatic agents.

The antistatic coating may be applied on the back surface of the support by, for example, spreading a solution comprising an antistatic agent (i.e., with a metering rod) onto the back surface of the support and then drying the support.

An example of one support of the present invention is Georgia Pacific brand Microprint Laser Paper. However, any commercially available laser copier/printer paper may be used as the support in the present invention.

4. The Release Layer

The release layer is formed on the support between the optional barrier layer and the design layer or between the support and the design layer. The release layer according to the present invention may have a solution viscosity of from 20 to 170 cP, preferably 70–150 cP, most preferably about 100–130 cP, as measured on a Brookfield DV-I+viscometer, LV1 spindle at 60 rpm at a temperature of 30° C. Additionally, the release layer may be wet coated in an amount of from 50 $g/m/^2$ to 150 $g/m^3$, preferably from 80–120 $g/m^2$, most preferably about 100 $g/m^2$. The surface tension of the release layer may be from 25–65 dynes/cm, preferably from 35–55 dynes/cm, most preferably about 45 dynes/cm as measured at room temperature.

In another embodiment, the components of the design layer and the components of the release layer are combined in the same layer. The release layer of the present invention facilitates the transfer of the image area from the support to the receptor. That is, the release layer of the present invention must provide the properties to effectively transfer the release layer and any images and/or optional layers thereon. Further, the release layer must also provide for adhesion of the release layer and the image area to the receptor without the requirement of a separate surface adhesive layer.

The release layer of the present invention may be prepared from, for example, a coating composition comprising an acrylic dispersion, an elastomeric emulsion, a plasticizer, and a water repellant. The water repellant may comprise, for example, polyurethane for the purpose of providing water resistance for colorant retention and/or a retention aid.

The release layer of the present invention protects any transferred image, provides mechanical and thermal stability, as well as washability, preferably without losing the flexibility of the textile. That is, the release layer should also provide a colorfast image (e.g. washproof or wash resistant) when transferred to the receptor surface. Thus, upon washing the receptor element (e.g. tee shirt), the image should remain intact on the receptor.

According to the present invention, the heat release layer may be a single layer or a plurality of heat release layers. Suitable materials for the heat release layer include polyvinylchloride plastisols which are dispersions of a vinyl resin in a non-aqueous liquid. Suitable plastisols, their preparation and application as heat release layers are described, for example, in U.S. Pat. No. 4,037,008. The heat release layer may also be a wax layer having a melting point lower than the barrier coating layer on the support sheet, if a barrier layer is present. Heat application to the transfer sheet melts the wax release layer allowing separation of the release layer from the backing sheet. Such wax release layers may be applied to the support sheet using an offset role as described in U.S. Pat. No. 4,322,467. The heat release layer described in U.S. Pat. No. 4,117,182 which contains an acrylic resin or cellulosic derivative, preferably in combination with a straight chain, primary aliphatic oxyalkylated alcohol, a plasticizer and a tackifier may also be used.

In one embodiment, the heat release layer is a two layer structure in which the first layer on top of said optional barrier layer or in contact with the support is a mixture of a vinyl resin and a polyethylene wax, and the second layer in contact with first layer is an ionomer polymer applied as a latex. The first layer is formed by heating the vinyl resin and wax and a solvent, such as toluene or a diluent such as odorless mineral spirits at a weight ratio of 70% solids to 30% solids, until the mixture is homogenous. When toluene is used, the mixture should be brought to a preferred temperature of from 82.2° C. to 96° C. in order to cause the resin to dissolve and liquefy. Suitable vinyl resins are copolymers of vinyl acetate and ethylene containing about 17–33% by weight vinyl acetate and having a melt index (as measured by ASTM D1238) of from 5 to 46.5. Suitable vinyl resins will have a resin density of about 0.933 to about 0.954 gm/cm$^3$ and a ring and ball softening point as measured by ASTM E28 of about 180° F. to 310° F. Suitable vinyl resins are commercially available as EVA 501 and EVA 505 from Union Carbide Corporation. The vinyl resin/wax mixture will generally contain 100–40 parts by weight vinyl resin and 20–80 parts wax.

Suitable polyethylene waxes are polyethylene waxes having a weight average molecular weight from about 1800 to 8000, a ring and ball softening point from about 100° C. to 120° C., a density from about 0.906–0.964 gm/cm$^3$ at 25° C. and a viscosity from about 230–1800 cp as measured by Brookfield Viscosity, No. 3 Spindle at 6 rpm. The polyethylene waxes may be either emulsifiable or non-emulsifiable. A suitable polyethylene wax is available as EPOLENE E14 from Eastman Chemical Products of Kingsport, Term.

The vinyl resin and polyethylene wax are blended together in heated solvent to form a hot clear solution which is uniformly applied over the support sheet using any conventional coating method such as an air knife, gravure roller or wire rod applicator. The first layer is preferably applied at about 3–10 lbs. per 1300 ft$^2$.

The second layer of ionomer polymer is applied over the first layer, preferably as a latex containing about 30% by weight polymer and 80% by weight water. Suitable ionomer dispersions are commercially available as 56220 SURLYN, 56230 SURLYN and 56256 SURLYN from E. I. DuPont. Ethylene-acrylic acid copolymers having an acrylic-acid content of about 17–20% by weight and a melt index of from about 300 to 500 may also be used as the ionomer polymer. If it is desired to extrude the second layer onto the first layer, and ethylene-acrylic acid copolymer containing about 3–15% by weight acrylic acid and having a melt index of about 2–11 can be used. The second layer is preferably applied at a rate of about 1–4 lbs per 1300 ft$^2$.

This type of heat release layer is fully described in U.S. Pat. No. 4,235,657. A suitable support sheet having disposed thereon one or more heat release layers is commercially available as ULTIMA from Kimberly-Clark Company.

Further, the release layer of the present invention satisfies the requirement for compatible components, in that the component dispersions remain in their finely dispersed state after admixture, without coagulating or forming clumps or aggregated particles which would adversely affect image quality. Additionally, the release layer is preferably non-yellowing.

The release layer has a low content of organic solvents, and any small amounts present during the coating process are sufficiently low as to meet environmental and health requirements. More specifically, the release layer preferably has a content of organic solvents of less than 2% weight by weight of components. More preferably, the release layer has a content of organic solvents of less than 1% weight by weight of components.

Particularly when the method for applying the image area of the design layer is a laser printer or copier, the release layer of the present invention preferably excludes wax dispersions derived from, for example, a group including but not limited to natural waxes such as carnauba wax, mineral waxes, montan wax, derivatives of montan wax, petroleum waxes, and synthetic waxes such as polyethylene and oxidized polyethylene waxes. If the imaging method used is a non-laser printer/copier method, waxes are not excluded from use in the transfer material. However, the amount of waxes that may be present in the transfer material of the invention when intended for use in laser printers or copiers must be sufficiently low as to avoid adverse affects on copier or printer operation. That is, the amount of wax present must not cause melting in the printer-or copier.

The above properties make this release layer highly suited for making compatible the stringent requirements of the electrostatic imaging process with the requirements of heat transfer image technology to provide a product having good image quality and permanence under the demanding conditions of textile application, wear and wash resistance in use, and adhesion to wash resistance on decorated articles. The release layer is preferably a polymeric coating designed to provide a release from the support and adherence to a receptor when heat is applied to the back of the support.

Suitable examples of the release layers of the invention are exemplified below.

In the an embodiment of the invention, the release layer comprises an ethylene acrylic acid co-polymer dispersion, an elastomeric emulsion, a polyurethane dispersion, and polyethylene glycol.

The acrylic dispersion is present in a sufficient amount so as to provide adhesion of the release layer and image to the receptor element and is preferably present in an amount of from 46 to 90 weight a, more preferably 70 to 90 weight % based on the total composition of the release layer.

The elastomeric emulsion provides the elastomeric properties such as mechanical stability, flexibility and stretchability, and is preferably present in an amount of from 1 to 45 weight %, more preferably 1 to 20 weight % based on the total composition of the release layer.

The water repellant provides water resistance and repellency, which enhances the wear resistance and washability of the image on the receptor, and is preferably present in an amount of from 1 to 7 weight %, more preferably 3 to 6 weight % based on the total composition of the release layer.

The plasticizer provides plasticity and antistatic properties to the transferred image, and is preferably present in an amount of from 1 to 8 weight %, more preferably 2 to 7 weight % based on the total composition of the release layer.

Preferably, the acrylic dispersion is an ethylene acrylic acid co-polymer dispersion that is a film-forming binder that provides the "release" or "separation" from the substrate. The release layer of the invention may utilize the film-forming binders of the image-receptive melt-transfer film layer of U.S. Pat. No. 5,242,739, which is herein incorporated by reference.

Thus, the nature of the film-forming binder is not known to be critical. That is, any film-forming binder can be employed so long as it meets the criteria specified herein. As a practical matter, water-dispersible ethylene-acrylic acid copolymers have been found to be especially effective film forming binders.

The term "melts" and variations thereof are used herein only in a qualitative sense and are not meant to refer to any particular test procedure. Reference herein to a melting temperature or range is meant only to indicate an approximate temperature or range at which a polymer or binder melts and flows under the conditions of a melt-transfer process to result in a substantially smooth film.

Manufacturers, published data regarding the melt behavior of polymers or binders correlate with the melting requirements described herein. It should be noted, however, that either a true melting point or a softening point may be given, depending on the nature of the material. For example, materials such as polyolefins and waxes, being composed mainly of linear polymeric molecules, generally melt over a relatively narrow temperature range since they are somewhat crystalline below the melting point.

Melting points, if not provided by the manufacturer, are readily determined by known methods such as differential scanning calorimetry. Many polymers, and especially copolymers, are amorphous because of branching in the polymer chains or the side-chain constituents. These materials begin to soften and flow more gradually as the temperature is increased. It is believed that the ring and ball softening point of such materials, as determined by ASTM E-28, is useful in predicting their behavior. Moreover the melting points or softening points described are better indicators of performance than the chemical nature of the polymer or binder.

Representative binders (i.e., acrylic dispersions) for release from the support are as follows:

Binder A

Binder A is Michem® 58035, supplied by Michelman, Inc., Cincinnati, Ohio. This is a 35 percent solids dispersion of Allied Chemical's AC 580, which is approximately 10 percent acrylic acid and 90 percent ethylene. The polymer reportedly has a softening point of 102° C. and a Brookfield viscosity of 0.65 pas (650 centipoise) at 140° C.

Binder B

This binder is Michem® Prime 4983R (Michelman, Inc., Cincinnati, Ohio). The binder is a 25 percent solids dispersion of Primacor® 5983 made by Dow Chemical Company. The polymer contains 20 percent acrylic acid and 80 percent ethylene. The copolymer has a Vicat softening point of 43° C. and a ring and ball softening point of 100° C. The melt index of the copolymer is 500 g/10 minutes (determined in accordance with ASTM D-1238).

Binder C

Binder C is Michem® 4990 (Michelman, Inc., Cincinnati, Ohio). The material is 35 percent solids dispersion of Primacor® 5990 made by Dow Chemical Company. Primacor® 5990 is a copolymer of 20 percent acrylic acid and 80 percent ethylene. It is similar to Primacor® 5983 (see Binder B), except that the ring and ball softening point is 93° C. The copolymer has a melt index of 1,300 g/10 minutes and Vicat softening point of 39° C.

Binder D

This binder is Michem® 37140, a 40 percent solids dispersion of a Hoechst-Celanese high density polyethylene. The polymer is reported to have a melting point of 100° C.

Binder E

This binder is Michem® 32535 which is an emulsion of Allied Chemical Company's AC-325, a high density polyethylene. The melting point of the polymer is about 138° C. Michem® 32535 is supplied by Michelman, Inc., Cincinnati, Ohio.

Binder F

Binder P is Michem® 48040, an emulsion of an Eastman Chemical Company microcrystalline wax having a melting point of 88° C. The supplier is Michelman, Inc., Cincinnati, Ohio.

Binder G

Binder G is Michem® 73635M, an emulsion of an oxidized ethylene-based polymer. The melting point of the polymer is about 96° C. The hardness is about 4–6 Shore-D. The material is supplied by Michelman Inc., Cincinnati, Ohio.

Another component of the release layer is an elastomeric emulsion, preferably a latex, and is compatible with the other components, and formulated to provide durability, mechanical stability, and a degree of softness and conformability to the layers.

Films of this material must have moisture resistance, low tack, durability, flexibility and softness, but with relative toughness and tensile strength. Further, the material should have inherent heat and light stability. The latex can be heat sensitized, and the elastomer can be self-crosslinking or used with compatible cross-linking agents, or both. The latex should be sprayable, or roll stable for continuous runnability on nip rollers.

Elastomeric latexes of the preferred type are produced from the materials and processes set forth in U.S. Pat. Nos. 4,956,434 and 5,143,971, which are herein incorporated by reference. This curable latex is derived from a major amount of acrylate monomers such as $C_4$ to $C_8$ alkyl acrylate, preferably n-butyl acrylate, up to about 20 parts per hundred of total monomers of a monolefinically unsaturated dicarboxylic acid, most preferably itaconic acid, a small amount of crosslinking agent, preferably N-methyl acrylamide, and optionally another monolefinic monomer.

Using a modified semibatch process in which preferably the itaconic acid is fully charged initially to the reactor with the remaining monomers added over time, a latex of unique polymer architecture or morphology is created, leading to the unique rubbery properties of the cured films produced therefrom.

Another component of the release layer is a water resistant aid such as a polyurethane dispersion which provides a self-crosslinking solvent and emulsifier-free aqueous dispersion of an aliphatic urethane-acrylic hybrid polymer which, alone, produces a clear, crack-free film on drying having very good scratch, abrasion and chemical resistance. This ingredient is also a softener for the acrylic-dispersion and plasticizer aid.

Such product may be produced by polymerizing one or more acrylate and other ethylenic monomers in the presence of an oligourethane to prepare oligourethane acrylate copolymers. The oligourethane is preferably prepared from diols and diisocyanates, the aliphatic or alicyclic based diisocyanates being preferred, with lesser amounts, if any, of aromatic diisocyanates, to avoid components which contribute to yellowing. Polymerizable monomers, in addition to the usual acrylate and methacrylate esters of aliphatic monoalcohols and styrene, further include monomers with carboxyl groups, such as acrylic acid or methacrylic acid, and those with other hydrophilic groups such as the hydroxyalkyl acrylates (hydroxyethyl methacrylate being exemplary). The hydrophilic groups in these monomers render the copolymer product dispersible in water with the aid of a neutralizing agent for the carboxyl groups, such as dimethylethanolamine, used in amount to at least partially neutralize the carboxyl groups after dispersion in water and vacuum distillation to remove any solvents used to prepare the urethane acrylic hybrid.

Further formulations may include the addition of crosslinking components such as amino resins or blocked polyisocyanates. Although pigments and fillers could be added to any of the coating layers, such use to uniformly tint or color the coated paper could be used for special effect, but would not be used where an image is desired in the absence of background coloration. Urethane acrylic hybrid polymers are further described in U.S. Pat. No. 5,708,072, and their description in this application is incorporated by reference.

Self crosslinking acrylic polyurethane hybrid compositions can also be prepared by the processes and materials of U.S. Pat. No. 5,691,425, herein incorporated by reference. These are prepared by producing polyurethane macromonomers containing acid groups and lateral vinyl groups, optionally terminal vinyl groups, and hydroxyl, urethane, thiourethane and/or urea groups. Polymerization of these macromonomers produces acrylic polyurethane hybrids which can be dispersed in water and combined with crosslinking agents for solvent-free coating compositions.

Autocrosslinkable polyurethane-vinyl polymers are discussed in detail in U.S. Pat. Nos. 5,623,016 and 5,571,861, and their disclosure of these materials is incorporated by reference. The products usually are polyurethane-acrylic hybrids, but with self-crosslinking functions. These may be carboxylic acid containing, neutralized with, e.g. tertiary amines such as ethanolamine, and form useful adhesives and coatings from aqueous dispersion.

The elastomeric emulsion and polyurethane dispersion are, generally, thermoplastic elastomers. Thermoplastic elastomeric polymers are polymer blends and alloys which have both the properties of thermoplastic polymers, such as having melt flow and flow characteristics, and elastomers, which are typically polymers which cannot melt and flow due to covalent chemical crosslinking (vulcanization). Thermoplastic elastomers are generally synthesized using two or more monomers that are incompatible; for example, styrene and butadiene. By building long runs of polybutadiene with intermittent polystyrene runs, microdomains are established which imparts the elastomeric quality to the polymer system. However, since the microdomains are established through physical crosslinking mechanisms, they can be broken by application of added energy, such as heat from a hand iron, and caused to melt and flow; and therefore, are elastomers with thermoplastic quality.

Thermoplastic elastomers have been incorporated into the present invention in order to provide the image transfer system with elastomeric quality. Two thermoplastic elastomer systems have been introduced; that is, a polyacrylate terpolymer elastomer (for example, Hystretch V-29) and an aliphatic urethane acryl hybrid (for example, Daotan VTW 1265). Thermoplastic elastomers can be chosen from a group that includes, for example, ether-ester, olefinic, polyether, polyester and styrenic thermoplastic polymer systems. Specific examples include, by way of illustration, thermoplastic elastomers such as polybutadiene, polybutadiene derivatives, polyurethane, polyurethane derivatives, styrene-butadiene, styrene-butadiene-styrene, acrylonitrile-butadiene, acrylonitrile-butadiene-styrene, acrylonitrile-ethylene-styrene, polyacrylates, polychloroprene, ethylene-vinyl acetate and poly (vinyl chloride). Generally, thermoplastic elastomers can be selected from a group having a glass transition temperature (Tg) ranging from about −50° C. to about 25° C.

Another component of the release layer is a plasticizer such as a polyethylene glycol dispersion which provides mechanical stability, water repellency, and allows for a uniform, crack-free film. Accordingly, a reason to add the polyethylene glycol dispersion is an aid in the coating process. Further, the polyethylene glycol dispersion acts as an softening agent. A preferred fourth component is Carbowax Polyethylene Glycol 400, available from Union Carbide.

Another optional ingredient of the release layer is a surfactant and wetting agent such as polyethylene glycol mono ((tetramethylbutyl) phenol) ether.

In another embodiment of the invention, the release layer comprises an acrylic binder and a wax emulsion. The release layer may further contain a retention aid such as Hercobond 2000°. The retention aid provides water resistance, which enhances the washability of the image on the receptor.

Various additives may be incorporated into the release layer or the barrier and/or image areas. Retention aids, wetting agents, plasticizers and water repellants are examples. Each will be discussed in turn, below.

An additive may be incorporated for the purpose of aiding in the binding of the applied colorant such as water-based ink jet colorants and/or dry or liquid toner formulations. Such additives are generally referred to as retention aids. Retention aids may be added in amounts of 0.5–90%, preferably 1–50%, most preferably 1–20% by weight. Retention aids that have been found to bind colorants generally fall into three classes: silicas, latex polymer and polymer retention aids. Silicas and silicates are employed when the colorant is water-based such as ink jet formulations. An example of widely used Silicas are the Ludox (DuPont) brands. Polyvinyl alcohol Represents as class of polymers that have also been applied to the binding of ink jet dyes. Other polymers used include anionic polymers such as Hercobond 2000 (Hercules). Reten 204LS (Hercules) and Kymene 736 (Hercules) are cationic amine polymer-epichlorohydrin adducts used as retention aids. Latex polymers include, by way of illustration, vinyl polymers and vinyl co-polymer blends such as ethylene-vinyl acetate, styrene-butadiene copolymers, polyacrylate and other polyacrylate-vinyl copolymer blends.

Wetting agents, rheology modifiers and surfactants may also be included in the release layer in amounts of 0.5–90%, preferably 1–50%, most preferably 1–20% by weight. Such agents may either be nonionic, cationic or anionic. The surfactant selected should be compatible with the class of polymers used in a formulation. For example, anionic polymers require the use of anionic or non-ionic wetting agents or surfactants. Likewise, cationic surfactants are stable in polymer solution containing cationic or non-ionic polymers. Examples of surfactants or wetting agents include, by way of illustration, alkylammonium salts of polycarboxylic acid, salts of unsaturated polyamine amides, derivatives of nonoxynol, derivatives of octoxynols (Triton X-100 and Triton X-114 (Union Carbide), for example), dimethicone copolymers, silicone glycol copolymers, polysiloxane-polyether copolymers, alkyl polyoxy carboxylates, tall oil fatting acids, ethylene oxide-propylene oxide block copolymers and derivatives of polyethylene glycol. Viscosity modifiers may also be included in amounts such as 0.5–90%, preferably 1–50%, most preferably 1–20% by weight. Generally, various molecular weight polyethylene glycols are incorporated to serve this purpose. Polyethylene glycols used generally range in molecular weight from 100 to 500,000 with molecular weights between 200 and 1000 being the most useful in this application.

Plasticizers may be included in order to soften hard polymer and polymer blend additions. Plasticizers may be added in amounts of 0.5–90%, preferably 1–50%, most preferably 1–20% by weight. Plasticizers used include, by way of illustration, aromatic derivatives such as di-octyl phthalate, di-decyl phthalate derivatives and tri-2-ethylhexyl trimellitate. Aliphatic plasticizers include derivatives of ethylhexyl adipates and ethylhexyl sebacates. Epoxidized linseed or soya oils may also be incorporated but generally are not used due to yellowing and chemical instability upon heat application.

Water repellant aids may also be incorporated into order to improve the wash/wear resistance of the transferred image. Water repellant aids may be added in amounts of 0.5–90%, preferably 1–50%, most preferably 1–20% by weight. Examples of additives include polyurethanes, wax dispersions such as carnauba wax, mineral waxes, montan wax, derivatives of montan wax, petroleum waxes, synthetic waxes such as polyethylene and oxidized polyethylene waxes, hydrocarbon resins, amorphous fluoropolymers and polysiloxane derivatives.

In yet another embodiment of the invention, the release layer and the design layer may be incorporated into the same layer. Specifically, the components of the release layer and the components of the design layer are both combined in the same layer. Examples of this type of system are discussed in U.S. Provisional Application 60/029,917 and 60/030,933.

5. The Design Layer

A design layer containing image and non-image area(s) is applied over the heat release layer. Optionally, as discussed above the components of the design layer may be combined with the components of the heat release layer in a single layer. The design layer may be applied by a conventional printing process, including application of halftone and color separations to the heat release layer by lithographic offset printing or other standard surface-to-surface printing processes. The halftone or full color processes may utilize standard air-drying process inks or latex-based air-drying inks. Printing may be conducted as a positive or negative image.

Suitable designs can be obtained on the design layer using standard lithographic inks. The inks should be selected so that the inks are compatible with the later heat treatment which is necessary to transfer the image to the substrate.

Heat resistant inks are, therefore, preferred. Drying speed can be improved by modifying the ink compositions to use a low quantity of drying oils and/or fast drying oils. The inks should also be selected such that the inks of the color separations are compatible with each other and with subsequent heat processing in order to produce an accurate sharp ink design.

Suitable inks having the properties identified above can be prepared by combining conventional red (rhodamine), yellow (benzedrine), blue (cyan) and black (process black) inks with an ink vehicle containing suitable resins and drying oils. A preferred ink vehicle contains 5–20 wt. %, preferably 7–13 wt. % of a drying (oxidizing) oil alkyd resin having an acid number of 2–25, preferably 5–20 and a Gardener Holdt viscosity of Z4 to Z6 at 25° C. The alkyd resin is preferably prepared using a sufficient amount of drying oil such that the oil length of the alkyd can be classified as a long oil alkyd of 50–90 wt. %, preferably 65–80 wt. % oil content.

The preferred ink vehicle also contains one or more esters of a modified rosin or polymerized rosin acid in an amount of about 5–30 wt. %, preferably 10–25 wt. %. These esters will generally have a melting point of about 120*C to 220° C., preferably 140° C. to 190° C. and an acid number of 5–35, preferably 8–25. In a particularly preferred embodiment, two pentaerythritol esters of modified rosin and polymerized rosin acids are used, 5–10 wt % of a first ester having a melting point of 140*C to 155° C. and an acid number of 8–25, and 5–15 wt. % of a second ester having a melting point of 175° C. to 190 CC and an acid number of 8–17.

Finally, the ink vehicle contains one or more drying oils in an amount of 2–15 wt. %, preferably 4–8 wt. %. Suitable drying oils include linseed oil, tung oil, etc., and mixtures thereof. Ink oils, preferably high boiling petroleum hydrocarbon fractions, are preferred solvents for the ink vehicle. Such ink oils are well known and generally have a boiling point range from about 200.degree.–300.degree. C., preferably 225.degree.–275.degree. C. and a K.B. value of 20–35, preferably 24–30. The ink oils and drying oils solubilize the alkyd resin enabling smooth application of the ink-containing vehicle with conventional lithographic offset printing equipment.

The design layer may also be formed through the use of conventional silver halide technology, CYCOLOR technology, or thermo-autochrome technology. Additionally, as already mentioned, the components of the design layer may be combined in the same layer as the components of the heat release layer.

6. The Optional Image Receiving Layer

If the design layer cannot be properly deposited on the release layer, an optional image receiving layer can be placed between the release layer and the design layer. The image receiving layer acts to retain the image areas of the design layer. Accordingly, the image receiving layer must be modified according to the marker that is being applied.

In an embodiment where the support is marked with a laser copier or printer, the optional image receiving layer is an acrylic coating upon which an image is applied. The image receiving layer may comprise a film-forming binder selected from the group comprising of ethylene-acrylic acid copolymers, polyolefins, and waxes. A preferred binder, especially when a laser copier or laser printer is used in accordance with this invention is an ethylene acrylic acid co-polymer dispersion.

In an embodiment of the invention, when an ink jet printer is used in accordance with the present invention, the image receiving layer may utilize the materials of the fourth layer of U.S. Pat. No. 5,798,179. Thus, for practicing the present invention using an ink jet printer, the image receiving layer may comprise particles of a thermoplastic polymer having largest dimensions of less than about 50 micrometers. Preferably, the particles will have largest dimensions of less than about 50 micrometers. More preferably, the particles will have largest dimensions of less than about 20 micrometers. In general, the thermoplastic polymer may be any thermoplastic polymer, which meets the criteria set forth herein. Desirably, the powdered thermoplastic polymer will be selected from the group consisting of polyolefins, polyesters, polyamides, and ethylene-vinyl acetate copolymers.

The image receiving layer also includes from about 10 to about 50 weight percent of a film-forming binder, based on the weight of the thermoplastic polymer. Desirably, the amount of binder will be from about 10 to about 30 weight percent. In general, any film-forming binder may be employed which meets the criteria set forth herein. When the image receiving layer includes a cationic polymer as described below, a nonionic or cationic dispersion or solution may be employed as the binder. Suitable binders include polyacrylates, polyethylenes, and ethylene-vinyl acetate copolymers. The latter are particularly desired because of their stability in the presence of cationic polymers. The binder desirably will be heat softenable at temperatures of about 120 DC or lower.

The basis weight of the image receiving layer may vary from about 3 to about 30 g/m$^2$. Desirably, the basis weight will be from about 10 to about 20 g/m$^2$. The image receiving layer may be applied by means well known to those having ordinary skill in the art, for example, as described herein below. The image receiving layer typically will have a melting point of from about 65° C. to about 180° C. Moreover, the image receiving layer may contain from about 2 to about 20 weight percent of a cationic polymer, based on the weight of the thermoplastic polymer. The cationic polymer may be, for example, an amide-epichlorohydrin polymer, polyacrylamides with cationic functional groups, polyethyleneimines, polydiallylamines, and the like. When a cationic polymer is present, a compatible binder should be selected, such as a nonionic or cationic dispersion or solution. As is well known in the paper coating art, many commercially available binders have anionically charged particles or polymer molecules. These materials are generally not compatible with the cationic polymer which may be used in the image receiving layer.

One or more other components may be used in the image receiving layer. For example, this layer may contain from about 1 to about 20 weight percent of a humectant, based on the weight of the thermoplastic polymer. Desirably, the humectant will be selected from the group consisting of ethylene glycol and poly(ethylene glycol). The poly (ethylene glycol) typically will have a weight-average molecular weight of from about 100 to about 40,000. A poly(ethylene glycol) having a weight-average molecular weight of from about 200 to about 800 is particularly useful.

The image receiving layer also may contain from about 0.2 to about 10 wt. % of an ink viscosity modifier, based on the weight of the thermoplastic polymer. The viscosity modifier desirably will be a poly(ethylene glycol) having a weight-average molecular weight of from about 100,000 to about 2,000,000. The poly(ethylene glycol) desirably will have a weight-average molecular weight of from about 100,000 to about 600,000.

Other components which may be present in the image receiving layer include from about 0.1 to about 5 weight percent of a weak acid and from about 0.5 to about 5 weight percent of a surfactant, both based on the weight of the thermoplastic polymer. A particularly useful weak acid is citric acid. The term "weak acid" is used herein to mean an acid having a dissociation constant less than one (or a negative log of the dissociation constant greater than 1).

The surfactant may be an anionic, a nonionic, or a cationic surfactant. When a cationic polymer is present in the image receiving layer, the surfactant should not be an anionic surfactant. Desirably, the surfactant will be a nonionic or cationic surfactant. However, in the absence of the cationic polymer, an anionic surfactant may be used, if desired. Examples of anionic surfactants include, among others, linear and branched-chain sodium alkylbenzenesulfonates, linear and branched-chain alkyl sulfates, and linear and branched-chain alkyl ethoxy sulfates. Cationic surfactants include, by way of illustration, tallow trimethylammonium chloride. Examples of nonionic surfactants, include, again by way of illustration only, alkyl polyethoxylates, polyethoxylated alkylphenols, fatty acid ethanol amides, complex polymers of ethylene oxide, propylene oxide, and alcohols, and polysiloxane polyethers. More desirably, the surfactant will be a nonionic surfactant. The image receiving layer may contain the addition of filler agents with the purpose of modulating the surface characteristics of the present invention. The surface roughness and coefficient of friction may need to be modulated depending on such factors as desired surface gloss and the imaging device's specific paper feeding requirements. The filler can be selected from a group of polymers such as, for example, polyacrylates, polyacrylics, polyethylene, polyethylene acrylic copolymers and polyethylene acrylate copolymers, vinyl acetate copolymers and polyvinyl polymer blends that have various particle dimensions and shapes. Typical particle sizes may range from 0.1 to 500 microns. Preferably, the particle sizes range from 5 to 100 microns. More preferably, the particle sizes range from 5 to 30 microns. The filler may also be selected from a group of polymers such as, for example, cellulose, hydroxycellulose, starch and dextran. Silicas and mica may also be selected as a filler. The filler is homogeneously dispersed in the image layer in concentrations ranging from 0.1 to 50%. Preferably, the filler concentration range is 1 to 10 percent.

By way of illustration, the image receiving layer may optionally comprise the following formulation compositions:

| Formulation | Description |
|---|---|
| A | 100 parts Orgasol 3501 EXDNAT 1 (a 10-micrometer average particle size, porous, copolymer of nylon 6 and nylon 12 precursors), 25 parts Michem Prime 4983, 5 parts Triton X100 and 1 part Methocel A-15 (methyl cellulose). The coating weight is 3.5 lb. Per 1300 square feet. |
| B | Like A, but with 5 parts of Tamol 731 per 100 parts Orgasol 3501, and the Metholcel A-15 is omitted. |
| C | Like a Reichold 97-635 release coat (a modified poly(vinyl acetate)), but containing 50 parts of Tone 0201 (a low molecular weight polycaprolactone) per 100 parts Orgasol 3501. |
| D | 100 parts Orgasol 3501, 5 parts Tamol 731, 25 parts Michel Prime 4983 and 20 parts PEG 20M. |
| E | 100 parts Orgasol 3501, 5 parts Tamol 731, 25 parts Michel Prime 4983 and 5 parts PEG 20M (a polyethylene glycol having a molecular weight of 20,000). |
| F | 100 parts Orgasol 3501, 5 parts Tamol 731, 25 parts Michem Prime 4983 and 20 parts PEG 20M (an ehtylene glycol oligomer having a molecular weight of 200). |
| G | 100 parts Orgasol 3501, 5 parts Tamol 731 and 25 parts Sancor 12676 (Sancor 12676 is a heat sealable polyurethane). |

7. The Optional Non-Water-Dispersible Polymer Layer

A polymer layer containing a non-water-dispersible polymer is optionally coated over the design layer. The non-water-dispersible polymer layer may be applied by any suitable coating process. Conveniently, the non-water-dispersible polymer layer is applied from a conventional coating tower suitable for use with lithographic offset printing equipment. The polymer coat formed by this process may be air-dried or, preferably is dried using a conventional infrared dryer.

The non-water-dispersible polymer layer is for example, a plastisol. Generally, a plastisol is a dispersion of polyvinylchloride (PVC) particles in liquid organic media. Plastisols are prepared using high boiling liquids which are absorbed by and plasticize the particles, and remain in the final product. Accordingly, the plastisols suitable for use in the non-water-dispersible polymer layer of the present invention are preferably plastisols which fall into the vinyl polymer class. For example, vinyl chloride polymers and copolymers. These vinyl polymers are generally polyvinyl chloride (PVC) polymer formulations. These PVC polymer formulations contain, in combination with PVC, for example, phthalate esters, inert fillers and/or organic/inorganic pigments. Specifically suitable examples include, but are not limited to, TransFlex Series, XL Flash 360 White (also known as Phantom White), and Bright Tiger White, all by Wilflex. These Wilflex products are composed of PVC, phthalate esters, inert fillers, and optionally organic/inorganic pigments.

The non-water-dispersible polymer layer of the present invention can also be applied as a clear coat base. For example, a clear plastisol base such as Soft Hand Clear #10140, by Wilflex. This clear plastisol base may also be combined with pigmented inks to form a colored non-water-dispersible polymer layer.

If viscosity modification is desired, reducers may be added. For example, if viscosity reduction is desired, up to wt. % of a reducer, such as Wilflex Curable Reducer #10070, may be added.

The polymers are commercially available for coating graphic arts paper or paper board with an in-line coater. The polymer dispersion is applied at a rate of 0.5–6.0, preferably 1.5–5.0 lbs per 1300 $ft^2$. The non-water-dispersible polymer layer is preferably applied using a 350 to 65 mesh. Dry coat weights range from about 10 to about 100 $g/m^2$, preferably about 50 $g/m^2$.

In another embodiment of the present invention, the non-water-dispersible polymer layer is applied over the image areas of the design layer only and the transfer blocking overcoat layer is applied over the non-image areas of the design layer only.

8. The Transfer Blocking Overcoat Layer

The transfer blocking overcoat layer is applied over the design layer or over the optional non-water-dispersible polymer layer of the present invention. Alternatively, as discussed above, the transfer blocking overcoat layer is applied over the non-image areas of the design layer only and the optional non-water-dispersible polymer layer is applied over the image areas of the design layer only.

The transfer blocking overcoat layer may be applied using a conventional printing process, preferably a conventional screen printing process. The transfer blocking overcoat layer is printed over the optional non-water-dispersible polymer layer or the non-image areas of the design layer, such that the transfer blocking overcoat layer outlines one or more of the image areas present in the design layer. That is, the transfer blocking overcoat layer outlines at least one imaged area or selected imaged areas and thereby circumferentially defines the outer boundary of each imaged area which will be transferred during the heat transfer process. By "selected imaged areas" the present invention is referring to an image area which is less than the entire image area present in the design layer. For instance, a portion of the total image area. In other words, if an imaged area is to be outlined by the transfer blocking overcoat layer, if desired, only a portion (or selected imaged areas) need be outlined. Thus, a plurality of imaged areas may be present in a single design layer, where the transfer blocking overcoat layer simultaneously defines the boundary of each imaged area or selected imaged areas. Preferably, the transfer blocking overcoat layer is applied to the optional polymer layer or the design layer so-that the transfer blocking overcoat layer covers the entire transfer sheet except the portion of the transfer sheet within the outline circumscribing the image area or areas which will be transferred. The transfer blocking overcoat layer does not cover the image area within the outline, that is, the transfer blocking overcoat layer is not present on the optional polymer layer or the design layer within the outline of the image area. It is noted that the phrase "selected image area" applies to the application of both the non-water-dispersible polymer layer and the transfer blocking overcoat layer.

The transfer blocking overcoat layer may additionally be coated such that it overlaps the outer perimeter of the image area to a small degree, for example, about one eighth of an inch.

To apply the transfer blocking overcoat layer several conventional techniques including but not limited to flexo, gravure, lithographic techniques and metering rod coating. First, the artisan must determine-what portions of the image areas which are desired to have a defined edge free from a polymer halo. Once this is established, the transfer blocking overcoat layer is applied, by one of the above methods to the boundry of that selected image area.

Application of sufficient heat through the support transfers the optional polymer layer, design layer, optional image-receiving layer, and heat release layer within the outline of the transfer blocking overcoat, onto and/or into the receptor.

The transfer blocking overcoat layer is, preferably, a thermosetting lacquer composition which fuses with the underlying optional polymer layer, design layer, optional image-receiving layer, heat transfer layer, and optional barrier layer when heat is applied to the transfer sheet, thereby preventing transfer of any portion of the transfer sheet which is covered by the transfer blocking overcoat layer. The transfer blocking overcoat layer is non-adhesive to the receptor and prevents formation of a polymer halo on the receptor.

The transfer blocking overcoat layer can be formed from a conventional industrial screen ink lacquer. The composition of the industrial lacquer may be varied widely and is not particularly limited so long as the lacquer is non-adhesive to the receptor and bonds to the underlying optional polymer layer or design layer, preventing heat transfer of the underlying layer. The industrial lacquer is preferably a polymeric, crosslinked resin material which may, optionally, contain a solid filler or pigment. Suitable crosslinked polymeric materials include epoxy-polyesters, epoxy-polyamides, polyisocyanate/polyester mixtures, polyisocyanate/polyol mixtures, urethane/acrylic mixtures. The transfer blocking overcoat may be opaque or transparent, or may contain a pigment or filler to impart a desired color. Preferably, the transfer blocking overcoat is clear or opaque to avoid any possibility of color transfer to the receptor during the heat transfer process.

The industrial lacquer used to form the transfer blocking overcoat layer may contain two or more crosslinkable polymeric components which react together to form the crosslinked transfer blocking overcoat layer. For example, a first component such as polymethyl polyphenylisocyanates, aromatic and aliphatic polyisocyanate prepolymers, toluene diisocyanate based adducts, copolymers of aromatic and aliphatic polyisocyanates, toluene polyisocyanurate, polyfunctional aliphatic isocyanates, blocked isocyanate prepolymers, 2,4-toluene diisocyanates, prepolymers of diphenyl methane L0 diisocyanates, epoxy and oxirane resins may be combined with a second component such as hydroxyl terminated castor oils, hydroxyl terminated linear and branched polyesters, acrylic resins and reactive polyamides to form a suitable crosslinkable thermosetting lacquer. The ratio of the first component to the second component is about 80:20 parts by weight to about 40:80 parts by weight, respectively. If desired, an organic solvent such as cellulose acetate butyrate or nitrocellulose solution may be used to dissolve the first and second lacquer components. The industrial screen ink lacquer of the transfer blocking overcoat layer is generally applied as a solution or dispersion in an organic solvent. Typically, the solvent constitutes about 10–80 parts by weight of the solution or dispersion. Acceptable solvents include alkyl, aryl and aralkyl ethers, aliphatic and aromatic hydrocarbons, as well as alkyl, aryl and aralkyl alcohols. Suitable lacquers are well known in the art and described, for example, in U.S. Pat. No. 3,959,555, U.S. Pat. No. 4,517,044, etc. Some industrial screen ink lacquers are available in the IL-000 series (tradename) of Nazdar Company, Chicago, Ill. which contain about 25–45 wt. % 2-butoxyethanol, 0–35 wt. % pigments, 10–20 wt. % resin material, 5–10 wt. % isopropanol, 0–16 wt. % petroleum distillates containing aromatic hydrocarbons, 0–6 wt. % crystalline silica, less than 4 wt. % toluene and 0–2 wt. % naphthalene.

Other non-limiting examples of the transfer blocking overcoat include, UVitec Aliphatic Coating (18846-87), UVitec Aromatic Coating (18955-87), UVitec Aliphatic Coating (18954-87), Sun Chemical UV RCF01498R, Epoxy Acryalate Varnish (INTER/UV-KOTE) by International Ink Company, and Cationic UV Overprint Varnishes (UCB Radcure Formulation). The INTER/UV-KOTE by International Ink Company is a clear to light amber colored viscous liquid having a specific gravity of less than 1.2. Preferred formulations are UVitec Aliphatic Coating (18846-87) and Sun Chemical UV RCF01498R.

The transfer blocking overcoats of the present invention may have a range of UV activated crosslinking concentrations of from about 0.01% to 20% by weight. For example, the Sun Chemical UV may have additional added photoinitiator and monomer at concentrations from 0.01% to 20% by weight.

The transfer blocking overcoat layer of the present invention may be applied with a screen size from 110 to 375 mesh, preferably 350 mesh. The transfer blocking overcoat layer is applied with a dry coat weight of 5 to 50 g/m$^2$, preferably 12 g/m$^2$. These coatings are applied by screen printing but could be applied by other methods (i.e., gravure, air knife, metered rod, etc.) with the coat weights above.

In another embodiment of the present invention, the transfer blocking overcoat layer is not applied. Therefore, the transfer sheet contains only a support, an optional barrier layer, an optional antistatic layer, at least one release layer, an optional image receiving layer, a design layer and a non-water-dispersible polymer layer. The non-water-dispersible polymer layer may cover the entire design layer or only the imaged areas or selected image areas.

Application of Layers

The various layers of the transfer material are formed by known coating techniques, such as by curtain coating, Meyer rod, roll, blade, air knife, cascade and gravure coating procedures.

The first layer to be coated on the support is the optional barrier layer. The barrier layer, if present, is followed by the release layer, followed by the optional image receiving layer, followed by the design layer, followed by the optional polymer layer, followed by the transfer blocking overcoat layer.

In referring to FIG. 1, there is generally illustrated a cross-sectional view of one embodiment of the transfer sheet of the present invention. The support 21 comprises a top and bottom surface. The optional barrier layer 22 is coated onto the top surface of the support 21. The heat release layer 23 is then coated onto the optional barrier layer 22. The optional image receiving layer 24 is coated on top of the heat release layer 23. The design layer 25 is coated on top of the optional image receiving layer 24. The design layer 25 contains both image areas 26 and non-image areas 27. The optional non-water-dispersible polymer layer 28 is coated on top of the design layer 25. The transfer blocking overcoat layer 29 is coated on top of the optional non-water-dispersible polymer layer 28, such that the transfer blocking overcoat layer 29 outlines one or more of the image areas 26 present in the design layer 25. The antistatic agent may optionally be applied to the non-coated side of the support as an antistatic layer 30.

Figure 2:
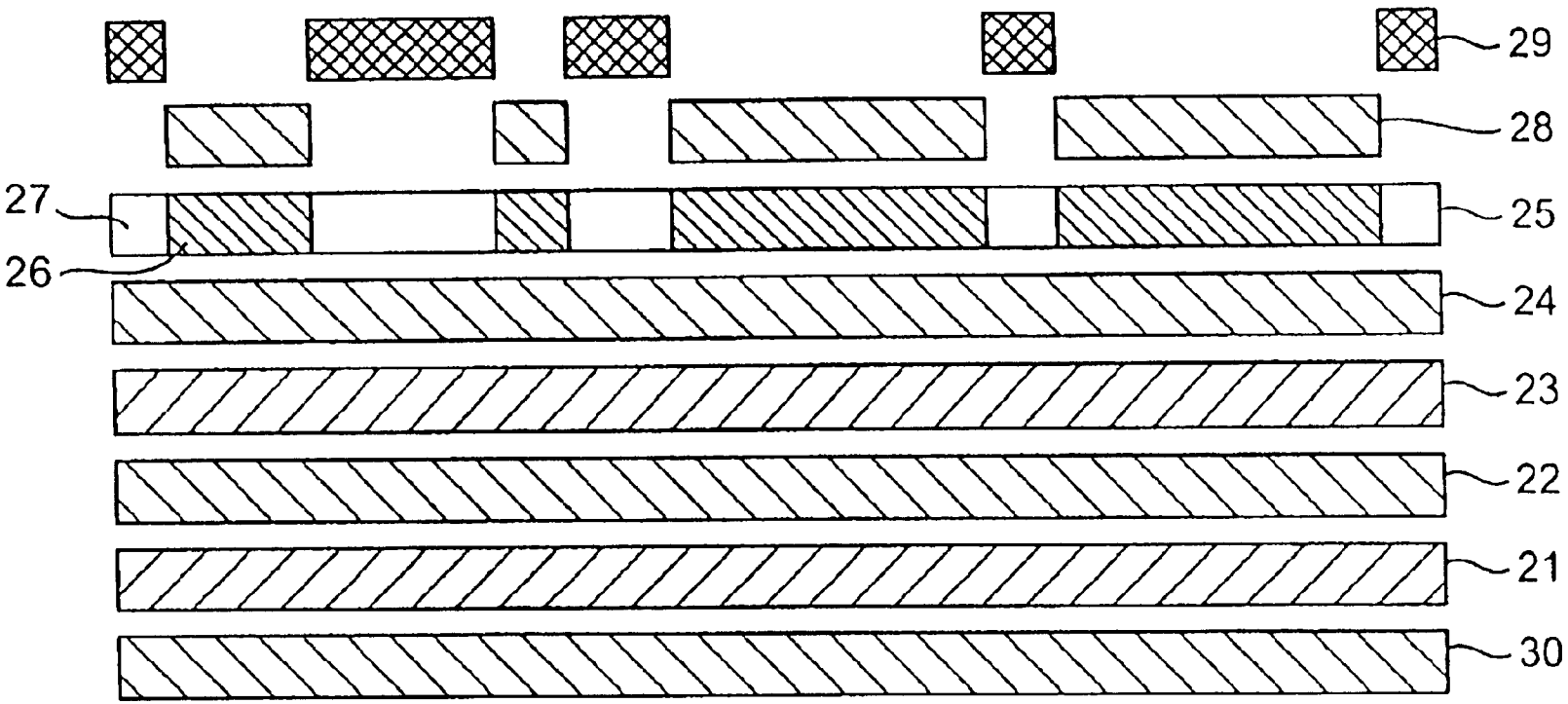
FIG. 2 is a cross-sectional view of another embodiment of the transfer element of the present invention.

In referring to FIG. 2, there is generally illustrated a cross-sectional view of one embodiment of the transfer sheet of the present invention. The support 21 comprises a top and bottom surface. The optional barrier layer 22 is coated onto the top surface of the support 21. The heat release layer 23 is then coated onto the optional barrier layer 22. The optional image receiving layer 24 is coated on top of the heat release layer 23. The design layer 25 is coated on top of the optional image receiving layer 24. The design layer 25 contains both image areas 26 and non-image areas 27. The non-water-dispersible polymer layer 28 is coated on top of one or more of the image areas 26 of the design layer 25. The transfer blocking overcoat layer 29 is coated on top of the non-image areas 27 of the design layer 25, such that the transfer blocking overcoat layer 29 outlines one or more of the image areas 26 present in the design layer 25. The antistatic agent may optionally be applied to the non-coated side of the support as an antistatic layer 30.

B. Receptor

The receptor or receiving element receives the transferred image. A suitable receptor includes but is not limited to textiles including cotton fabric, and cotton blend fabric. The receptor element may also include glass, metal, wool, plastic, ceramic or any other suitable receptor. Preferably the receptor element is a tee shirt or the like.

The image, as defined in the present application may be applied in any desired manner. For example, the image may be generated by means of silver halide technology, CYCOLOR technology or thermo-autochrome technology. The image may also be formed by a color or monochrome laser printer, laser copier, bubblejet printer, inkjet printer, and the like. The image may also formed by any suitable method of application, including painting, crayons or markers.

To transfer the image, the imaged transfer element is placed image side against a receptor. A transfer device (i.e., a hand iron or a conventional pneumatic heat press) is used to apply heat to the substrate which in turn releases the image. The temperature transfer range of the hand iron is generally in the range of 110 to 220° C. with about 190° C. being the preferred temperature. The pneumatic heat press operates at a temperature transfer range of 100 to 220° C. with about 190° C. being the preferred temperature.

The transfer device is placed over the non-image side of the support and moved in a circular motion (hand iron only). Pressure (i.e., typical pressure applied during ironing) must be applied as the heating device is moved over the support (see FIG. 3). However, according to the present invention, the pressure supplied by the pneumatic heat press is not necessary. Specifically, the amount of pressure necessary to carry out the present invention is much less than that necessary for typical pneumatic heat press transfers. Specifically, many transfers requiring a pneumatic heat press require at least 30 psi in order to achieve efficient image transfer. However, the present invention is capable of operating at a pressure of less than 30 psi or less than 10 psi or less than 5 psi in order to achieve efficient image transfer. In fact, a typical hand-iron transfer creates about 1–2 psi. This is all the pressure which is necessary to efficiently transfer an image according to the present invention. However, a pneumatic heat press may also be used in the present invention. After about two minutes to five minutes (with about three minutes being preferred) using a hand iron and 10 seconds to 50 seconds using a heat press (with about twenty seconds being preferred) of heat and pressure, the transfer device is removed from the support. The transfer material is optionally allowed to cool from one to five minutes. The support is then peeled away from the image which is adhered to the receptor.

Figure 3:
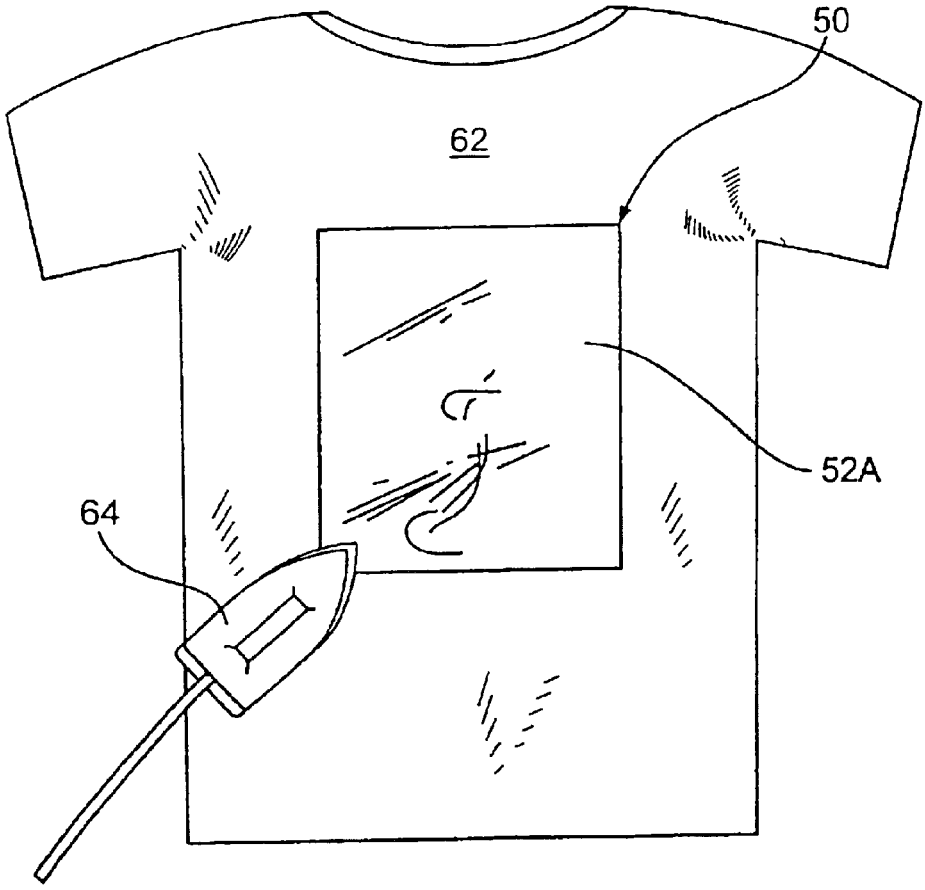

Referring to FIG. 3, the method of applying an image to a receptor element will be described. More specifically, FIG. 3 illustrates how the step of heat transfer from the transfer sheet 50 to a tee shirt or fabric 62 is performed. A tee shirt 62 is laid flat, as illustrated, on an appropriate support surface, and the imaged surface of the transfer sheet 50 is positioned onto the tee shirt. An iron 64 set at its highest heat setting is run and pressed across the back 52A of the transfer sheet. The image areas which are outlined by the transfer blocking overcoat layer 29 are transferred to the tee shirt and the transfer sheet is removed and discarded.

Additional embodiments of the present invention include substituting the transfer material of the present invention as the support and transfer layer in U.S. Patent Application 60/056,446, wherein the transfer material of the present invention is used in conjunction with a silver halide emulsion layer. Further, silver halide grains may be dispersed in the release layer of the present invention in the same manner as described in U.S. Patent Application 60/029,917.

The transfer material of the present invention may be used in place of the support and transfer layer of U.S. Patent Application 60/065,806, wherein the transfer material of the present invention is used in conjunction with CYCOLOR technology. The transfer material of the present invention may additionally be used as the transfer layer of U.S. Patent Application 60/065,804, wherein the release layer of the present invention is used in conjunction with thermo-autochrome technology. Further, the microcapsules may be dispersed within the release layer of the present invention in lieu of a separate transfer layer as in U.S. Patent Application 60/030,933.

An additional embodiment of the present invention is a coated transfer sheet comprising, as a barrier layer, a vinyl acetate-dibutyl maleate polymer dispersion that has a Tg of about −7° C. (such as Barrier Layer Formulation 1 comprising EVERFLEX G, discussed below). As the Release Layer, the third layer of U.S. Pat. No. 5,798,179 to Kronzer (US '179) may be used. That is, the Release Layer may comprise a thermoplastic polymer which melts in a range of from about 65° C. to about 180° C. and has a solubility parameter less than about 19 $(Mpa)^{1/2}$.

The third layer in U.S. '179 functions as a transfer coating to improve the adhesion of subsequent layers in order to prevent premature delamination of the heat transfer material. The layer may be formed by applying a coating of a film-forming binder over the second layer. The binder may include a powdered thermoplastic polymer, in which case the third layer will include from about 15 to about 80 percent by weight of a film-forming binder and from about 85 to about 20 percent by weight of the powdered thermoplastic polymer. In general, each of the film-forming binder and the powdered thermoplastic polymer will melt in a range from about 65° C. to about 180° C. For example, each of the film-forming binder and powdered thermoplastic polymer may melt in a range from about 80° C. to about 120° C. In addition, the powdered thermoplastic polymer will consist of particles which are from about 2 to about 50 micrometers in diameter.

The following examples are provided for a further understanding of the invention, however, the invention is not to be construed as limited thereto.

EXAMPLES

Example 1

In one embodiment of the invention, the barrier layer is a vinyl acetate polymer. An example of this embodiment is Barrier Layer Formulation 1:

Barrier Layer Formulation 1

| Components | Parts |
|---|---|
| Vinyl acetate-dibutyl maleate polymer dispersion (such as EVERFLEX G, Hampshire Chemical Corporation) | 50 parts |
| Water | 50 parts. |

Barrier Layer Formulation 1 may be prepared as follows: fifty parts of a vinyl acetate-dibutyl maleate polymer dispersion are combined with fifty parts of water by gentle stirring. The stirring is continued for approximately ten minutes at a moderate stir rate (up to but not exceeding a rate where cavitation occurs). The amount of water added may vary. The only limitation is that sufficient water is added to make the dispersion coatable on the substrate.

Example 2

An example of the PMMA-containing barrier layer is Barrier Layer Formulation 2:

| Barrier Layer Formulation 2 | |
|---|---|
| Components | Parts |
| Acetone 99.5% | 40 parts (weight) |
| 2-Propanol 99.5% | 40 parts (weight) |
| PMMA | 20 parts (weight). |

Barrier Layer Formulation 2 may be prepared as follows: The acetone and 2-propanol are weighed and mixed. The mixture is stirred. One half of the PMMA is added to the mixture while the mixture is heated to about 25° C. and stirring continues until the PMMA is dispersed. At this point, stirring continues until the remainder of the PMMA is added to the mixture and is dispersed. The mixture is then allowed to cool to room temperature.

Example 3

This example relates to a release layer formulation. This is referred to as Release Layer Formulation 1:

| Release Layer Formulation 1 | |
|---|---|
| Components | Parts by weight |
| Ethylene Acrylic Acid Co-polymer Dispersion (Michem Prime 4983R, Michelman) | 86 parts |
| Elastomeric emulsion (Hystretch V-29, B F Goodrich) | 5 parts |
| Polyurethane Dispersion (Daotan VTW 1265, Vianova Resins) | 4 parts |
| Polyethylene Glycol (Carbowax Polyethylene Glycol 400, Union Carbide) | 4 parts |
| Polyethylene Glycol Mono ((Tetramethylbutyl) Phenol) Ether (Triton X-100, Union Carbide) | 1 part |

Release Layer Formulation 1, as an embodiment of the invention suitable for laser copiers and laser printers, is wax free. Release Layer Formulation 1 may be prepared as follows: five parts of the elastomer dispersion are combined with eighty-six parts of an ethylene acrylic acid co-polymers dispersion by gentle stirring to avoid cavitation. Four parts of a polyurethane dispersion are then added to the mixture. Immediately following the addition of a polyurethane dispersion, four parts of a polyethylene glycol and one part of an nonionic surfactant (e.g., Triton X-100) are added. The entire mixture is allowed to stir for approximately fifteen minutes at a moderate stir rate (up to but not exceeding a rate where cavitation occurs). Once thoroughly combined, the mixture is filtered (for example, through a 53 $\mu$m nylon mesh).

Example 4

This example relates to another release layer formulation, Release Layer Formulation 2:

| Release layer Formulation 2 | |
|---|---|
| Components | Parts |
| Ethylene Acrylic Acid Co-polymers dispersion (Michem Prime 4938R, Michelman) | 74 parts (weight) |
| Wax Dispersion (Michelman 73635M, Michelman) | 25 parts (weight) |
| Retention Aid (Hercobond 2000, Hercules) | 1 part (weight) |

Formulation 2 works in a laser printer or copier despite the presence of wax since the wax is present in sufficiently low amounts so as to not adversely affect imaging such as, for example, by melting within the printer or copier (i.e., at most about 25 parts (weight)).

Formulation 2 may be prepared in the following manner: the ethylene acrylic acid co-polymer dispersion and the wax dispersion are stirred (for example in a beaker with a stirring bar). The retention aid is added, and the stirring continues until the retention aid is completely dispersed.

In another embodiment of the invention, the above-described release layer is divided into two separate layers. An example of this embodiment is a layer comprising ethylene acrylic acid that allows release or separation. An elastomer and polyurethane of the present invention, as well as any additives discussed above, are combined in a second layer that provides the above-described transfer qualities.

Example 5

This example relates to an image receiving layer formulation, Image Receiving Layer Formulation 1:

| Image Receiving Layer Formulation 1 | |
|---|---|
| Components | Parts |
| Ethylene Acrylic Acid Co-polymers Dispersion (Michem Prime 4983R, Michelman). | 100 parts |

Alternatively, the binders suitable for Release Layer Formulation 1 may be used in lieu of the above-described ethylene acrylic acid copolymer dispersion.

Example 6

This example relates to is an image receiving layer formulation that further contains a filler agent:

| Compound | Parts |
|---|---|
| Ethylene Acrylic Copolymer Dispersion (Michem 4983R, Michelman) | 90 to 99 |
| Ethylene Vinyl Acetate Copolymer Powder (Microthene FE-532-00, Equistar Chemical) | 10 to 1 |

Example 7

This example relates to another image receiving layer formulation that further contains a filler agent.

| Image Receiving Layer Formulation 3 | |
|---|---|
| Compound | Parts |
| Ethylene Acrylic Copolymer Dispersion (Michem 4983R, Michelman) | 90 to 99 |
| Oxidized polyethylene homopolymer (ACumist A-12, Allied Signal Chemical) | 10 to 1 |

Example 8

This example relates to a transfer blocking overcoat layer formulation (all % are % by weight based on the total weight of the formulation).

| Formulation A | |
|---|---|
| Eb 745 | 50% |
| OTA-480 | 40% |
| Eb P115 | 4% |
| Eb BPO | 5% |
| PA 11 | 0.5% |
| Byk 344 | 0.5% |

Eb 745 is an acrylic oligomer, OTA-480 is a propoxylated glycerol triacrylate monomer, Eb P115 is an amine-functional acrylate additive, Eb BPO is benzophenone, PA 11 is a photoinitiator, and Byk is a silicone additive. All components are products of UCB-Radcure, except for Byk 344 which is a product of BYK Chemie (USA). Formulation A is prepared by mixing the above-listed components in their listed order under gentle stirring.

Example 9

This example relates to another transfer blocking overcoat layer formulation (all % are % by weight based on the total weight of the formulation).

| Formulation B | |
|---|---|
| Eb 3600 | 18% |
| DPHPA | 15% |
| HDODA | 7% |
| Eb 350 | 0.5% |
| Eb BPO | 7% |
| Tego Airex | 0.5% |

Eb 3600 is an imine-modified Bisphenol A epoxy acrylate resin, DPHPA is an acrylated dipentaerythritol, HDODA is a 1,6-hexanediol diacrylate, Eb 350 is an acrylated silicone, Eb BPO is benzophenone. All components are products of UCB-Radcure, except for Tego Airex which a product of Tego Chemie Service (USA). Formulation B is prepared by mixing the above-listed components in their listed order under gentle stirring.

Example 10

A transfer sheet according to the present invention is prepared as follows. Aluminum lithographic printing plates are prepared by color separating a selected color design using conventional lithographic color separation techniques. The lithographic printing plates are then mounted in a lithographic printing press into which are loaded individual support sheets having applied thereto one or more heat release layers (ULTIMA available from Kimberly-Clark Company,) and inks corresponding to the lithographic color separations. The press is then run in a conventional manner printing the images onto the paper which has been readily dried using conventional infrared (IR) drying.

The transfer blocking overcoat layer is then applied by conventional screen printing to all portions of the printed paper with the exception of the image areas of the design layer to complete the image transfer of the invention. The transfer blocking overcoat layer consists of Sun Chemical UV RCF01498R applied with a 350 screen mesh and a dry coat weight of 12 g/m$^2$.

The transfer of the image area from the image transfer sheet is completed by placing a 100% cotton shirt into a hard surface, applying heat and pressure from a conventional iron for a time sufficient to transfer the image area to the shirt and then removing the printed shirt from the hard surface. The fused expended transfer sheet is manually removed from the shirt to provide a printed shirt having excellent hand and a clear printed image.

Example 11

A transfer sheet according to the present invention is prepared as follows. Aluminum lithographic printing plates are prepared by color separating a selected color design using conventional lithographic color separation techniques. The lithographic printing plates are then mounted in a lithographic printing press into which are loaded individual support sheets having applied thereto one or more heat release layers (ULTIMA available from Kimberly-Clark Company,) and inks corresponding to the lithographic color separations. A non-water-dispersible polymer emulsion is loaded into a conventional spray column suitable for applying a thin film of the polymer onto the design layer printed sheets. The press is then run in a conventional manner printing the images onto the paper and applying a film of the polymer dispersion which has been readily dried using conventional infrared (IR) drying. As the non-water-dispersible polymer, Tiger Bright White plastisol is applied with a 310 mesh and a dry coat weight of 50 g/m$^2$.

The transfer blocking overcoat layer is then applied as in Example 11 by conventional screen printing to all portions of the printed paper with the exception of the image areas of the design layer to complete the image transfer of the invention.

The transfer of the image area from the image transfer sheet is completed by placing a 100% cotton shirt into a hard surface, applying heat and pressure from a conventional iron for a time sufficient to transfer the image area to the shirt and then removing the printed shirt from the hard surface. The fused expended transfer sheet is manually removed from the shirt to provide a printed shirt having excellent hand and a clear printed image.

Example 12

Example 11 is repeated, however, the polymer layer is coated over image areas only and the transfer blocking overcoat layer is coated over non-image areas only.

Example 13

Another transfer sheet of the present invention is prepared as follows:

A barrier layer comprising a vinyl acetate-dibutyl maleate dispersion is coated onto a support of the present invention (i.e., onto laser printer or copier paper). For the purposes of this Example, the barrier layer is Barrier Layer Formulation 1. The vinyl acetate-dibutyl maleate polymer dispersion is coated by, for example, applying the dispersion in a long line across the top edge of the paper. Using a #10 metering rod, the bead of solution is spread evenly across the paper. The coated paper is force air dried for approximately one minute. Coating can also be achieved by standard methods such as curtain, air knife, cascade, etc.

Once the barrier layer has completely dried, the release layer solution is coated directly on top of the barrier layer.

For this Example, the release layer is Release Layer Formulation 1. The release layer solution is applied in a long line across the top edge of the paper and barrier layer. Using a #30 metering rod, the bead of solution is spread evenly across the substrate. This drawdown procedure is twice repeated. The coated paper is force air dried for approximately two minutes.

Once the release layer has completely dried, the (optional) image receiving layer solution is coated directly on top of the release layer For the purposes of this Example, the image receiving layer is Image Receiving Layer 1. Accordingly, the image receiving layer comprises ethylene acrylic acid. The image receiving layer solution is applied in a long line across the top edge of the release layer. Using a #4 metering rod, the bead of solution is spread evenly across the substrate. The coated support is force air dried for approximately one minute.

Once the support is dry, it is placed into a laser printer or copier and imaged upon. The following table can be used as a guide to determine optimum coating weights and thickness of the Barrier, Release and Image Layers:

Coat Weights and Thickness

| | Parts | Wet Coat ($g/m^2$) | Dry Coat ($g/m^2$) | Thickness (mil) |
|---|---|---|---|---|
| Barrier Layer | 50 | 28 | 2 to 20 | 0.05 to 0.80 |
| Release Layer | 95 | 96.2 | 12 to 50 | 0.48 to 2.00 |
| Image Layer | 100 | 20 | 2 to 25 | 0.05 to 1.0 |

The (optional) non-water-dispersible polymer layer is then coated over the image layer. Upon the (optional) polymer layer is then coated the transfer blocking overcoat layer. The transfer blocking overcoat layer is only coated over the non-image areas. The non-water dispersible polymer layer and the transfer blocking overcoat layer are applied as in Example 12.

Example 14

This example relates to another method of coating the support. The first layer to be coated on laser printer or copier paper is a barrier layer of 18% PMMA solution (see, for example Barrier Layer Formulation 2). The 18% PMMA solution is poured into a tray. A sheet of paper is rolled through the solution, coating only one side. Once the paper is coated, the excess PMMA solution is allowed to drain off the paper by dripping and the paper is allowed to dry. Once the barrier layer has completely dried, the release layer solution is coated directly on top of the barrier layer as shown in Example 13. The image receiving layer is applied as shown in Example 13. Then the (optional) non-water-dispersible polymer layer and the transfer blocking overcoat layer are applied as shown in Example 13.

Example 15

This Example demonstrates the image transfer procedure. Referring to FIG. 3, to transfer the image, (1) the support 21 is placed image side against a receptor (tee shirt) of the present invention. The receptor of this example includes but is not limited to cotton fabric, cotton blend fabric, glass and ceramic. A transfer device of the present invention (i.e., a hand iron or heat press) is used to apply heat to the substrate second surface of the support, which in turn releases the image areas 26. The temperature of the hand iron is about 190° C. The heat press operates at a temperature transfer range of about 190° C. (2) The transfer device is placed over the second surface of the support 21 and moved in a circular motion (if the hand iron is used). Usual pressure applied when ironing is applied as the heating device is moved over the support 21. After about 180 seconds (15 seconds if using the heat press) of heat and pressure, the transfer device is removed from the support 21. The support 21 is allowed to cool for about five minutes. (3) The support 21 is then peeled away from the receptor.

Example 16

This example relates to another method of applying an image to a receptor element will be described. More specifically, FIG. 3 illustrates how the step of heat transfer from the transfer sheet 50 to a tee shirt or fabric 62 is performed.

The transfer sheet is prepared as described in the Examples 13 and 14. A tee shirt 62 is laid flat, as illustrated, on an appropriate support surface, and the imaged surface of the transfer sheet 50 is positioned onto the tee shirt. An iron 64 set at its-highest heat setting is run and pressed across the back 52A of the transfer sheet. The image areas only are transferred to the tee shirt and the transfer sheet is removed and discarded.

Example 17

A transfer sheet of the present invention is prepared according to examples 13 and 14, however, the image area is prepared with a silver halide emulsion.

Silver halide grains as described in Example 1 of U.S. Patent Application 60/056,446 are prepared by mixing a solution of 0.3 M silver nitrate with a solution of 0.4 M sodium chloride.

Thus, in this example, the silver halide grains are coated on top of the present transfer material in the same manner as in conventional photographic systems.

The sensitized paper is exposed and processed in the same manner as described in U.S. Patent Application 60/056,446. That is, the sensitized paper is exposed to room light for about 30 seconds and then developed in color treatment chemistry known in the art as RA-4 Eastman Kodak). The working solution RA-4 is a paper development color process. The coupler magenta, cyan or yellow color coupling dye is added to the RA-4 working solution before development. Therefore, it is similar to the color development process known as the K-14 Kodachrome process (Eastman Kodak). The test sample is a sample of what a magenta layer (red-blue hue) would look like if separated. The resulting uniform image contains both the silver and color coupler dyes. Both the material and dye image can withstand bleaching to remove silver, thereby leaving only the color image. The material is then dried.

The resulting photographic image is transferred as in Example 15, above.

Example 18

Example 17 is repeated, except that the silver halide grains are dispersed in the Release Layer of the present invention in the same manner as described in U.S. Patent Application 60/029,917 where the silver halide grains are dispersed in the transfer layer.

Example 19

A transfer sheet according to Examples 13 and 14 is prepared except that the image areas are prepared using a layer of photosensitive microcapsules as described in U.S. Pat. No. 4,904,645. The photosensitive microcapsules are coated onto the transfer material of the present invention in the manner described in Example 1 of U.S. Patent Application 60/065,806. The coated sheet is then image-wise exposed through a mask for 5.2 seconds using a fluorescent light source. The exposed transfer sheet is processed at high temperatures with a calendaring roll as described in Example 1 of U.S. Pat. No. 4,751,165. After exposure the transfer sheet is then applied to a receptor in the manner described in Example 15, above.

Example 20

Example 19 is repeated, except the microcapsules are dispersed in the Release Layer of the present invention in the same manner as the microcapsules are dispersed in the transfer layer as shown in Example 1 of U.S. Patent Application 60/030,933. That is, photosensitive microcapsules are prepared in the manner described in U.S. Pat. No. 4,904,645 and are dispersed in the Release Layer of the present invention. The transfer sheet is then prepared in the manner described in Example 13 of the present invention. Then, the coated sheet is then image-wise exposed through a mask for 5.2 seconds using a fluorescent light source. The exposed sheet is processed at high temperatures with a calendaring roll as described in Example 1 of U.S. Pat. No. 4,751,165. After exposure the transfer sheet is then applied to a substrate in the manner described in Example 15, above.

Example 21

The light-fixable thermal recording layer according to Example 2 of U.S. Pat. No. 4,771,032 is coated as the image area of the present example 13 in the same manner as in Example 1 of U.S. Patent Application 60/065,894, where a light-fixable thermal recording layer according to Example 2 of U.S. Pat. No. 4,771,032 is coated onto the transfer layer. The obtained recording material is then subjected to the procedure described in U.S. Pat. No. 5,486,446 as follows.

Applied power to thermal head and pulse duration are set so that the recording energy per area is 35 mJ/mm$^2$. The writing of the heat-sensitive recording material is conducted using a thermal head (KST type, a product of Kyocera K.K.).

Subsequently, the recording material is exposed to an ultraviolet lamp (light emitting central wavelength: 420 nm; output 40W for 10 seconds. Applied power to the thermal head and pulse duration are again set so that the recording energy per unit area is 62 mJ/mm$^2$, and writing of the heat-sensitive recording material is conducted under these applied energies.

Furthermore, the recording material is exposed to an ultraviolet lamp (light emitting central wavelength: 365 nm; output: 40W) for 15 seconds. Applied power to the thermal head and pulse duration are again set so that the recording energy per unit is 86 mJ/mm$^2$, and writing of the heat-sensitive recording material is conducted under these conditions. The coated transfer sheet is prepared, exposed, and developed according to U.S. Patent Application 60/065,804.

Example 22

Example 21 is repeated, except that the microcapsule-containing direct thermal recording imaging element is dispersed in the release layer in the same manner as the microcapsules are dispersed in the transfer material as shown in U.S. Patent Application No. 60/030,933. That is, the microcapsules are blended together with Release Layer Formulation 1 of the present invention. The transfer sheet is then exposed as demonstrated in Example 21, above. The exposed transfer sheet is then transferred as demonstrated in Example 15, above.

Example 23

Example 13 is repeated, except that once the image layer has completely dried, the following antistatic layer is coated on the backside of the support the previously non-coated side).

| Antistatic Layer Solution Formulation 1 | |
|---|---|
| Water | 90 parts |
| Quaternary ammonium salt solution (Statik-Blok J-2, Amstat Industries) | 10 parts |

The antistatic solution is applied in a long line across the top edge of the substrate using a #4 metering rod. The coated support is force air dried for approximately one minute.

The antistatic solution of this Example has the following characteristics: the solution viscosity as measured on a Brookfield DV-I+ viscometer, LV1 spindle @ 60 RPM is 2.0 (cP) at 24.5° C. The coating weights (wet) are 10 to 20 g/m$^2$. The surface tension is 69.5 dynes/cm at 24° C.

Once the support and antistatic coating are dry, the coated transfer sheet is placed into an electrostatic printer and imaged upon.

Example 24

Example 23 is repeated, except that following formulation is used as the antistatic layer and is coated on the backside of the substrate (the previously non-coated side)

| Antistatic Layer Solution Formulation 2 | |
|---|---|
| Water | 90 parts |
| Polyether (Marklear ALF-23, Witco Ind.) | 5 parts. |

All cited patents, publications-, copending applications, and provisional applications referred to in this application are herein incorporated by reference.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image transfer sheet, comprising:

a support sheet having a first and a second surface;

at least one release layer on said first surface of said support sheet;

a design layer comprising imaged areas on said release layer;

a non-water-dispersible polymer layer; and a transfer blocking overcoat layer on said non-water-dispersible polymer layer, wherein said transfer blocking overcoat layer outlines at least one imaged area or selected imaged areas in said design layer, but does not cover said image area within the outline, wherein said transfer blocking overcoat layer allows transfer of only said release layer, said image areas of the design layer and said non-water-dispersible polymer layer within said outlined image area.

2. The image transfer sheet according to claim 1, which further comprises a barrier layer between the first surface of said support sheet and said release layer.

3. The image transfer sheet according to claim 1, which further comprises an image-receiving layer between said release layer and said design layer.

4. The image transfer sheet according to claim 1, which further comprises an antistatic layer on the second surface of said support sheet.

5. The image transfer sheet according to claim 1, wherein said non-water-dispersible polymer is a plastisol.

6. The image transfer sheet according co claim 1, wherein said transfer blocking overcoat layer is clear or opaque.

7. The image transfer sheet according to claim 1, wherein said transfer blocking overcoat layer is a screen ink lacquer.

8. The image transfer sheet according to claim 7, wherein said lacquer contains a polymeric crosslinked resin.

9. The image transfer sheet according to claim 8, wherein said resin is selected from the group consisting of epoxy-polyesters, epoxypolyamides, polyisocyanate/polyester mixtures, polyisocyanate/polyol mixtures, polyisocyanate/acrylic mixtures, polyisocyanate/polyamide mixtures and urethane/acrylic mixtures.

10. The image transfer sheet according to claim 1, wherein said transfer can be performed with a pressure of less than 30 psi.

11. An image transfer sheet, comprising:

a support sheet having a first and a second surface;

at least one release layer on said first surface of said support sheet;

a design layer-comprising imaged areas on said release layer;

a non-water-dispersible polymer layer on said design layer; and a transfer blocking overcoat layer, wherein said transfer blocking overcoat layer outlines at least one imaged area or selected image areas on said design layer, but does not cover said image area within the outline, and said non-water-dispersible polymer layer covers areas within the outline of the transfer blocking polymer layer, wherein said transfer blocking overcoat layer allows transfer of only said release layer, said outlined image area of the design layer, and said non-water-dispersible polymer layer within said outlined image area.

12. The image transfer sheet according to claim 11, which further comprises a barrier layer between the first surface of said support sheet and said release layer.

13. The image transfer sheet according to claim 11, which further comprises an image-receiving layer between said release layer and said design layer.

14. The image transfer sheet according to claim 11, which further comprises an antistatic layer on the second surface of said support sheet.

15. The image transfer sheet according to claim 11, wherein said non-water-dispersible polymer is a plastisol.

16. The image transfer sheet according to claim 11, wherein said transfer blocking overcoat layer is clear or opaque.

17. The image transfer sheet according to claim 11, wherein said transfer blocking overcoat layer is a screen ink lacquer.

18. The transfer sheet according to claim 17, wherein said lacquer contains a polymeric crosslinked resin.

19. The transfer sheet according to claim 18, wherein said resin is selected from the grout consisting of epoxypolyesters, epoxypolyamides, polyisocyanate/polyester mixtures, polyisocyanate/polyol mixtures, polyisocyanate/acrylic mixtures, polyisocyanate/polyamide mixtures and urethane/acrylic mixtures.

20. The image transfer sheet according to claim 11, wherein said transfer can be performed with a pressure of less than 30 psi.

21. An image transfer sheet, comprising:

a support sheet having a first and a second surface;

at least one release layer on said first surface of said support sheet;

a design layer comprising imaged areas on said release layer; and a transfer blocking overcoat layer, wherein said transfer blocking overcoat layer outlines at least one image area or selected image areas on said design layer, but does not cover said at least one image area, wherein said transfer blocking overcoat layer allows transfer of only said release layer, and said outlined image area of the design layer within said outlined image area, wherein said transfer can be performed with a pressure of less than 30 psi.

22. The image transfer sheet according to claim 21, which further comprises a barrier layer between the first surface of said support sheet and said release layer.

23. The image transfer sheet according to claim 21, which further comprises an image-receiving layer between said release layer and said design layer.

24. The image transfer sheet according to claim 21, which further comprises an antistatic layer on the second surface of said support sheet.

25. The image transfer sheet according to claim 21, wherein said transfer blocking overcoat layer is clear or opaque.

26. The image transfer sheet according to claim 21, wherein said transfer blocking overcoat layer is a screen ink lacquer.

27. The transfer sheet according to claim 26, wherein said lacquer contains a polymeric crosslinked resin.

28. The transfer sheet according to claim 27, wherein said resin is selected from the group consisting of epoxypolyesters, epoxypolyamides, polyisocyanate/polyester mixtures, polyisocyanate/polyol mixtures, polyisocyanate/acrylic mixtures, polyisocyanate/polyamide mixtures and urethane/acrylic mixtures.

29. An image transfer sheet, comprising:

a support sheet having a first and a second surface;

an optional barrier layer on said first surface of said support sheet;

at least one release layer on said optional barrier layer, wherein said release layer contains components which form imaged areas;

an optional non-water-dispersible polymer layer on said release layer; and a transfer blocking overcoat layer, wherein said transfer blocking overcoat layer outlines at least one imaged area or selected imaged areas, but does not cover said at least one image area, wherein said transfer blocking overcoat layer allows transfer of only said optional barrier layer, said release layer, said outlined image area, and said optional non-water-dispersible polymer layer within said outlined image area.

30. An image transfer sheet, comprising:

a support sheet having a first and a second surface;

at least one release layer on said first surface of said support sheet;

a design layer comprising imaged areas on said release layer; and a non-water-dispersible polymer layer on said design layer, wherein said non-water-dispersible polymer layer covers at least one image area or selected image areas on said design layer.

31. A process for heat transferring an imaged area from a transfer sheet to a receptor, comprising the steps:

contacting a receptor with the transfer blocking overcoat layer of the image transfer sheet of claim 1;

applying heat and pressure to the second surface of the support sheet sufficient to transfer said image area to said receptor to form an imaged receptor; and removing said image transfer sheet, without the outlined imaged area, from said imaged receptor.

32. The process according to claim 31, wherein said heat is applied at a temperature from about 110 to 220° C.

33. The process according to claim 31, wherein said pressure is applied at less than 30 psi.

34. The process according to claim 33, wherein said pressure is applied at less than 20 psi.

35. A process for heat transferring an imaged area from a transfer sheet to a receptor, comprising the steps:

contacting a receptor with the transfer blocking overcoat layer of the image transfer sheet of claim 11;

applying heat and pressure to the second surface of the support sheet sufficient to transfer said image area to said receptor to form an imaged receptor; and removing said image transfer sheet, without the outlined imaged area, from said imaged receptor.

36. The process according to claim 35, wherein said heat is applied at a temperature from about 110 to 220° C.

37. The process according to claim 35, wherein said pressure is applied at less than 30 psi.

38. The process according to claim 37, wherein said pressure is applied at less than 20 psi.

39. A process for heat transferring an imaged area from a transfer sheet to a receptor, comprising the steps:

contacting a receptor with the transfer blocking overcoat layer of the image transfer sheet of claim 21;

applying heat and pressure to the second surface of the support sheet sufficient to transfer said image area to said receptor to form an imaged receptor; and removing said image transfer sheet, without said outlined imaged area, from said imaged receptor.

40. The process according to claim 39, wherein said heat is applied at a temperature from about 110 to 220° C.

41. The process according to claim 40, wherein said pressure is applied at less than 30 psi.

42. The process according to claim 41, wherein said pressure is applied at less than 20 psi.

43. A process for heat transferring an image area from a transfer sheet to a receptor, comprising the steps:

contacting a receptor with a transfer blocking overcoat layer of the image transfer sheet of claim 29;

applying heat and pressure to the support sheet sufficient to transfer said image area to said receptor to form an imaged receptor; and removing said image transfer sheet from said imaged receptor.

44. A process for heat transferring an image area from a transfer sheet to a receptor, comprising the steps:

contacting a receptor with a transfer blocking overcoat layer of the image transfer sheet of claim 30;

applying heat and pressure to the support sheet sufficient to transfer said image area to said receptor to form an imaged receptor; and removing said image transfer sheet from said imaged receptor.

* * * * *